US008192904B2

(12) United States Patent
Nagai et al.

(10) Patent No.: US 8,192,904 B2
(45) Date of Patent: Jun. 5, 2012

(54) ELECTROPHOTOGRAPHIC PHOTOCONDUCTOR, AND IMAGE FORMING APPARATUS AND PROCESS CARTRIDGE USING THE SAME

(75) Inventors: Kazukiyo Nagai, Numazu (JP); Hongguo Li, Numazu (JP); Tetsuro Suzuki, Fuji (JP); Harukazu Okuda, Echizen (JP)

(73) Assignees: Ricoh Company, Ltd., Tokyo (JP); Nissin Chemical Industry Co., Ltd., Echizen-shi (JP)

( * ) Notice: Subject to any disclaimer, the term of this patent is extended or adjusted under 35 U.S.C. 154(b) by 1040 days.

(21) Appl. No.: 11/763,853

(22) Filed: Jun. 15, 2007

(65) Prior Publication Data

US 2007/0292780 A1 Dec. 20, 2007

(30) Foreign Application Priority Data

Jun. 16, 2006 (JP) ..... 2006-167421

(51) Int. Cl.
*G03G 15/04* (2006.01)

(52) U.S. Cl. ..... 430/66; 430/58.2; 430/123.42; 399/159

(58) Field of Classification Search ..... 430/58.2, 430/66, 123.42; 399/159
See application file for complete search history.

(56) References Cited

U.S. PATENT DOCUMENTS 6,899,983 B2 5/2005 Tamoto et al.
7,160,658 B2 1/2007 Suzuki et al.
7,175,957 B2 2/2007 Suzuki et al.
7,179,573 B2 2/2007 Suzuki et al.
7,659,044 B2 * 2/2010 Li et al. ..... 430/66
2004/0053152 A1 3/2004 Nagai et al.
2005/0266328 A1 12/2005 Yanagawa et al.
2006/0014093 A1 1/2006 Li et al.

FOREIGN PATENT DOCUMENTS

JP 2003-202701 7/2003
JP 2004-020649 1/2004
JP 2006-47949 2/2006
JP 2006-099048 4/2006

OTHER PUBLICATIONS

U.S. Appl. No. 12/000,239, filed Dec. 11, 2007, Fujiwara, et al.
U.S. Appl. No. 12/035,016, filed Feb. 21, 2008, Iwamoto, et al.
U.S. Appl. No. 12/047,011, filed Mar. 12, 2008, Kami, et al.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

An electrophotographic photoconductor including: an outermost layer, wherein the outermost layer comprises an amino group-containing acryl-modified polyorganosiloxane, wherein the amino group-containing acryl-modified polyorganosiloxane is a copolymer in which a polyorganosiloxane represented by the following structural formula (1) and an acrylic monomer are graft-polymerized Structural Formula (1)

14 Claims, 6 Drawing Sheets

ELECTROPHOTOGRAPHIC PHOTOCONDUCTOR, AND IMAGE FORMING APPARATUS AND PROCESS CARTRIDGE USING THE SAME

BACKGROUND OF THE INVENTION

1. Field of the Invention

The present invention relates to an electrophotographic photoconductor (hereinafter may be referred to as "photoconductor," "latent electrostatic image bearing member," or "image bearing member") that can provide high-quality image formation and high-speed printing using a spherical toner with a small particle diameter, that can provide an excellent toner recycling efficiency and low-temperature toner fixing properties, that can provide excellent toner cleaning in a low temperature and low humidity environment, that is robust against environmental variability, and that can provide high-quality image formation for a long period of time without involving lubricant application, and an image forming apparatus and process cartridge using the electrophotographic photoconductor.

2. Description of the Related Art

In recent years electrophotographic full-color image formation has been widely used, with a strong demand for high image quality. As a strategy for meeting such a demand it is known to use a spherical toner with a uniform, small particle diameter that can significantly enhance fine-dot reproducibility. The production of such a toner has been realized through polymerization processes, and spherical toners with a small particle diameter have been commonly used.

As a method for cleaning transferred toner particles remained on the photoconductor in an electrophotographic image forming apparatus, a blade cleaning method is widely used that involves contact between a cleaning blade and a photoconductor for toner cleaning. Although this method is most suitable particularly in high-speed printing machines, there is a problem that small, spherical toner articles offer poor cleanability with a blade. To solve this problem, application of a lubricant on the photoconductor has been carried out for improving cleanability. However, since lubricants degrade chargeability of recovered toner particles by being mixed with them, they cause difficulties in toner recycling.

In addition, environment impact reduction has also been a highly marketable requirement and it has been desired to lower the fixing temperature in an electrophotographic image forming apparatus. To that end, it is effective to lower the glass transition temperature of toner. As a method for producing a spherical toner having a uniformly, small particle diameter and a low glass transition temperature, Japanese Patent Application Laid-Open (JP-A) No. 2003-202701 discloses a method that includes the steps of dispersing in an aqueous medium a modified polyester resin that is reactive with an active hydrogen group-containing compound, a coloring agent, and a releasing agent under the presence of a dispersing agent, allowing the obtained dispersion liquid to react with at least one of a crosslinking agent and an elongating agent, and removing a solvent from the dispersion liquid.

However, a toner produced by this proposed method has a spherical shape with a uniform, small particle diameter. Thus the toner is hardly removed by blade cleaning, particularly in a low temperature and low humidity environment, making it difficult to achieve image output without lubricant application.

BRIEF SUMMARY OF THE INVENTION

In response to the prior requests, an object of the present invention is to solve such problems inherent in the prior art and to achieve the following object. That is, an object of the present invention is to provide an electrophotographic photoconductor that can provide high-quality image formation and high-speed printing using a spherical toner with a small particle diameter, that can provide an excellent toner recycling efficiency and low-temperature toner fixing properties, that can provide excellent cleanability in a low temperature and low humidity environment, that is robust against environmental variability, and that can provide high-quality image formation for a prolonged period without lubricant application, and also provide an image forming apparatus and a process cartridge using the electrophotographic photoconductor.

The means for solving the problems are as follows:

<1> An electrophotographic photoconductor including: an outermost layer, wherein the outermost layer includes an amino group-containing acryl-modified polyorganosiloxane, wherein the amino group-containing acryl-modified polyorganosiloxane is a copolymer in which a polyorganosiloxane represented by the following structural formula (1) and an acrylic monomer are graft-copolymerized, Structural Formula (1)

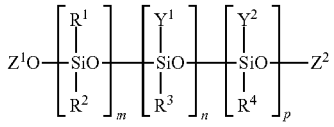

wherein $R^1$, $R^2$, $R^3$ and $R^4$ may be identical or different, and represent one of a hydrocarbon group having 1 to 20 carbon atoms and halogenated hydrocarbon group having 1 to 20 carbon atoms; $Y^1$ represents an organic group having at least one of a radical reactive group and SH group; $Y^2$ represents an organic group having an amino group; $Z^1$ and $Z^2$ may be identical or different, and represent any one of a hydrogen atom, alkyl group, and group represented by the following structural formula (1-1); m is a positive integer of 10,000 or less; and n and p each are an integer of 1 or more, Structural Formula (1-1)

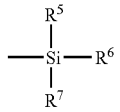

wherein $R^5$ and $R^6$ may be identical or different, and represent one of a hydrocarbon group having 1 to 20 carbon atoms and halogenated hydrocarbon group having 1 to 20 carbon atoms; and $R^7$ represents any one of a hydrocarbon group having 1 to 20 carbon atoms, halogenated hydrocarbon group having 1 to 20 carbon atoms, and organic group having at least one of a radical reactive group and SH group.

<2> The electrophotographic photoconductor according to <1>, wherein the mass ratio (A:B) between the polyorganosiloxane (A) represented by the structural formula (1) and the acrylic monomer (B) is from 40:60 to 80:20.

<3> The electrophotographic photoconductor according to one of <1> and <2>, wherein the acrylic monomer is one of a (meth)acrylate represented by the following structural formula (2), and a mixture of the (meth)acrylate represented by the following structural formula (2) and a monomer copolymerizable with the (meth)acrylate, Structural Formula (2)

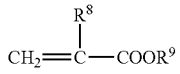

wherein $R^8$ represents one of a hydrogen atom and methyl group; and $R^9$ represents any one of an alkyl group, alkoxy substituted-alkyl group, cycloalkyl group, and aryl group, and these groups may further be substituted with one or more substituents.

<4> The electrophotographic photoconductor according to <3>, wherein the mass ratio (C:D) between the (meth) acrylate (C) represented by the structural formula (2) in the mixture and the monomer (D) copolymerizable with the (meth)acrylate in the mixture is from 99.9:0.1 to 70:30.

<5> The electrophotographic photoconductor according to any one of <1> to <4>, including: a support; and a photosensitive layer formed on the support, wherein the photosensitive layer is an outermost layer.

<6> The electrophotographic photoconductor according to any one of <1> to <4>, including: a support; a charge generating layer; and a charge transporting layer, wherein the charge generating layer and the charge transporting layer are sequentially disposed on the support, wherein the charge transporting layer is the outermost layer.

<7> The electrophotographic photoconductor according to any one of <1> to <4>, including: a support; a photosensitive layer; and a surface protective layer, wherein the photosensitive layer and the surface protective layer are sequentially disposed on the support, wherein the surface protective layer is the outermost layer.

<8> The electrophotographic photoconductor according to <7>, wherein the surface protective layer contains an acrylic curable resin produced by means of chain polymerization reaction between a chain-polymerizable charge transporting compound with one or more chain-polymerizable groups in a molecule and chain-polymerizable compound with three or more functional groups.

<9> An image forming apparatus including: the electrophotographic photoconductor according to any one of <1> to <8>; a latent electrostatic image forming unit configured to form a latent electrostatic image on the electrophotographic photoconductor; a developing unit configured to develop the latent electrostatic image using a toner to form a visible image; a transferring unit configured to transfer the visible image onto a recording medium; a fixing unit configured to fix the transferred image on the recording medium; and a cleaning unit configured to remove residual toners on the electrophotographic photoconductor, wherein the toner has an average circularity of 0.92 to 1, a volume average particle diameter (Dv) of 4 μm to 8 μm, and the ratio between the volume average particle diameter (Dv) and a number average particle diameter (Dn) is 1.00 to 1.40.

<10> The image forming apparatus according to <9>, wherein the toner is obtained by dissolving and/or dispersing in an organic solvent a toner material containing an active hydrogen group-containing compound, a modified polyester resin that is reactive with the active hydrogen group-containing compound, a coloring agent, and a releasing agent to prepare a toner solution, emulsifying and/or dispersing the toner solution in an aqueous medium to prepare a dispersion liquid, allowing the active hydrogen group-containing compound and the modified polyester resin to react in the aqueous medium, and removing the organic solvent.

<11> The image forming apparatus according to one of <9> and <10>, wherein the cleaning unit is a cleaning blade that contacts the surface of the electrophotographic photoconductor.

<12> An image forming method including: forming a latent electrostatic image on the electrophotographic photoconductor according to any one of <1> to <8>; developing the latent electrostatic image using a toner to form a visible image; transferring the visible image onto a recording medium; fixing a transferred visible image on the recording medium; and cleaning to remove a residual toner on the electrophotographic photoconductor, wherein the toner has an average circularity of 0.92 to 1, a volume average particle diameter (Dv) of 4 μm to 8 μm, and the ratio between the volume average particle diameter (Dv) and a number average particle diameter (Dn) is 1.00 to 1.40.

<13> The image forming method according to <12>, wherein the toner is obtained by dissolving and/or dispersing in an aqueous medium a toner material containing an active hydrogen group-containing compound and a polymer that is reactive with the active hydrogen group-containing compound, emulsifying and/or dispersing the toner solution to prepare a dispersion liquid, allowing the active hydrogen group-containing compound and the polymer that is reactive with the active hydrogen group-containing compound to react in the aqueous medium, and producing an adhesive base material in a particle state.

<14> The image forming method according to one of <12> and <13>, wherein the cleaning step is performed by using a cleaning blade that contacts the surface of the electrophotographic photoconductor.

<15> A process cartridge including: the electrophotographic photoconductor according to any one of <1> to <8>; and at least one selected from a charging unit configured to charge the surface of the electrophotographic photoconductor; a developing unit configured to develop a latent electrostatic image formed on the electrophotographic photoconductor using a toner to form a visible image; a transferring unit configured to transfer the visible image onto a recording medium; and a cleaning unit configured to remove a residual toner on the electrophotographic photoconductor, wherein the process cartridge is detachably attached to an image forming apparatus body, wherein the toner has an average circularity of 0.92 to 1, a volume average particle diameter (Dv) of 4 μm to 8 μm, and the ratio between the volume average particle diameter (Dv) and a number average particle diameter (Dn) is 1.00 to 1.40.

<16> The process cartridge according to <15>, wherein the toner is obtained by dissolving and/or dispersing in an organic solvent a toner material containing an active hydrogen group-containing compound, a modified polyester resin that is reactive with the active hydrogen group-containing compound, a coloring agent, and a releasing agent to prepare a toner solution, emulsifying and/or dispersing the toner solution in an aqueous medium to prepare a dispersion liquid, allowing the active hydrogen group-containing compound and the modified polyester resin that is reactive with the active hydrogen group-containing compound to react in the aqueous medium, and removing the organic solvent.

<17> The process cartridge according to one of <15> and <16>, wherein the cleaning unit is a cleaning blade that contacts the surface of the electrophotographic photoconductor.

The electrophotographic photoconductor of the present invention includes an outermost layer which contains at least an amino group-containing acryl-modified polyorganosiloxane. The amino group-containing acryl-modified polyorganosiloxane has a graft-polymerized structure in which acrylic resin portions are graft-polymerized as side chains with several portions of a main chain of polyorganosiloxane; thus compositions with two different characteristics coexist in the polymer. Besides, the amino group-containing acryl-modified polyorganosiloxane is partially cross-linked, forms particles with a primary particle diameter of 50 nm to 100 nm, and has a special structure in which two components exist in a phase-separated state in a particle. A typically known amine structure-containing acryl-modified polyorganosiloxane is an acryl-modified polyorganosiloxane in which an amine structure is introduced in an acrylic resin portion, and a characteristic improvement of a part of its particle has been successful; however, it is speculated that a characteristic improvement of the entire particle has been unsuccessful. In addition, it is speculated that the probability that a polyorganosiloxane component with a small surface energy exists at the surface side of a particle increases and thereby most part of the acrylic resin portions hides inside the particle, leading to poor surface improvement effect.

The amino group-containing acryl-modified polyorganosiloxane of the present invention, on the other hand, is one in which the characteristic of entire particle surface has been successfully improved by the presence of a large proportion of polyorganosiloxane structure portion, with amino groups contained in those of the polyorganosiloxane structure portions that are highly likely to reside around the surface side of particle.

The mechanism has not yet been clarified by which a favorable cleanability can be achieved by introducing such an improved amino group-containing acryl-modified polyorganosiloxane into the surface of an organic photoconductor (OPC) even in a low temperature and low humidity environment where cleanability generally degrades due to a spherical toner having a small particle diameter which is difficult to be removed; however, the principle underlying the mechanism is speculated as follows.

When a toner is removed by blade cleaning, it is preferable to form a toner dam in front of the blade. As the condition that the toner dam is formed in front of the blade, it is speculated that dam formation may be achieved in a region where the aggregation force between toner particles is greater than the adhesion force between a toner particle and an OPC. The degree of adhesion force between toner and OPC is significantly affected by the electrostatic attraction which is generated due to friction between toner and OPC. Particularly, it is believed that electrostatic attraction increases when the toner particle diameter is small and when used in a low humidity environment where static electricity tends to be accumulated. In addition, it is expected that cleaning of toners by a blade in a low temperature and low humidity environment becomes difficult due to the influence of rolling of toner particles that occurs when they are spherical and further to the change of elastic behavior of the blade at low temperatures. Accordingly, in order to improve cleanability of the generated toners, it is effective to reduce generation of static electricity that occurs due to contact between toner and OPC. It is believed that the generation of static electricity is inhibited by reducing the surface resistances of both of toner and OPC; however, it is required for toner and OPC to have a charging function for the formation of high quality images. Hence, a method for simply reducing the electric resistances of toner and OPC results in failure to overcome difficulties associated with formation of high-quality images. This leads to another thought that frictional electrification may be inhibited if charging hierarchies of the two objects can be adjusted to the same level so as to reduce the amount of charge generated by friction. A toner is a resin particle in which a charge control agent, an external additive, a wax component and the like originally exist at the particle surface, and thus has a very complex system. By introducing a structure which changes surface potential to the surface side of an OPC may reduce the adhesion force with toner particles. In the present invention, it is considered that the above-mentioned balance may be achieved by introducing an amino group, i.e. an electron donating group.

It is considered that the improvement of characteristics of the entire particle by introducing an amino group as structure that can adjust friction chargeability to the main chain structure portion of an acryl-modified polyorganosiloxane and achievement of sustained electrostatic characteristics of the OPC surface with reduced friction coefficient by introducing fine particles uniformly to the OPC surface led to the provision of an electrophotographic photoconductor that can provide high-quality image formation and high-speed printing using a spherical toner with a small particle diameter, that can provide an excellent toner recycling efficiency and low-temperature toner fixing properties, that can provide excellent cleanability in a low temperature and low humidity environment, that is robust against environmental variability, and that can provide high-quality image formation for a prolonged period without lubricant application; an image forming apparatus; and a process cartridge using the electrophotographic photoconductor.

According to the present invention, it is possible to solve such problems inherent in the prior art and to provide an electrophotographic photoconductor that can provide high-quality image formation and high-speed printing using a spherical toner with a small particle diameter, that can provide an excellent toner recycling efficiency and low-temperature toner fixing properties, that can provide excellent cleanability in a low temperature and low humidity environment, that is robust against environmental variability, and that can provide high-quality image formation for a prolonged period without lubricant application; also provide an image forming apparatus and process cartridge using the electrophotographic photoconductor.

Figure 1:
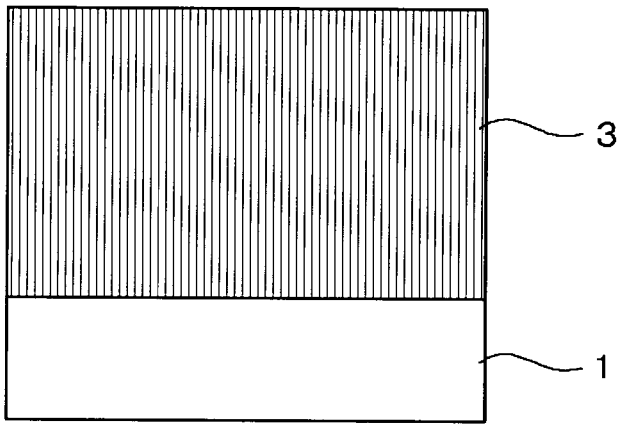
FIG. 1 is a schematic sectional view showing an example of the single-layered electrophotographic photoconductor of the present invention.

DETAILED DESCRIPTION OF THE INVENTION (Electrophotographic Photoconductor)

The electrophotographic photoconductor of the present invention includes an outermost layer which contains at least an amino group-containing acryl-modified polyorganosiloxane, and further includes other components as necessary.

<Amino Group—Containing Acryl-Modified Polyorganosiloxane>

The amino group-containing acryl-modified polyorganosiloxane may be a copolymer produced by graft copolymerizing a polyorganosiloxane represented by the following structural formula (1), and an acrylic monomer, Structural Formula (1)

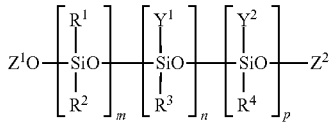

wherein $R^1$, $R^2$, $R^3$ and $R^4$ may be identical or different, and represent any one of a hydrocarbon group having 1 to 20 carbon atoms and a halogenated hydrocarbon group having 1 to 20 carbon atoms; $Y^1$ represents an organic group having at least one of a radical reactive group and a SH group; $Y^2$ represents an organic group having an amino group; $Z^1$ and $Z^2$ may be identical or different, and represent any one of a hydrogen atom, alkyl group, and group expressed by the following structural formula (1-1); m is a positive integer of 10,000 or less; and n and p each are an integer of 1 or more, Structural Formula (1-1)

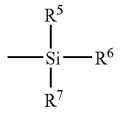

wherein $R^5$ and $R^6$ may be identical or different, and represent any one of a hydrocarbon group having 1 to 20 carbon atoms and a halogenated hydrocarbon group having 1 to 20 carbon atoms; and $R^7$ represents any one of a hydrocarbon group having 1 to 20 carbon atoms, a halogenated hydrocarbon group having 1 to 20 carbon atoms, and an organic group having at least one of a radical reactive group and a SH group.

In the polyorganosiloxane shown in the structural formula (1), $R^1$, $R^2$, $R^3$ and $R^4$ may be identical or different, and represent one of a hydrocarbon group having 1 to 20 carbon atoms and a halogenated hydrocarbon group having 1 to 20 carbon atoms.

Examples of the hydrocarbon groups having 1 to 20 carbon atoms include alkyl groups and aryl groups.

Examples of the alkyl groups include a methyl group, ethyl group, propyl group, and butyl group.

Examples of the aryl groups include a phenyl group, tolyl group, xylyl group, and naphthyl group.

Examples of the halogenated hydrocarbon groups having 1 to 20 carbon atoms include those in which at least a hydrogen atom bonded to a carbon atom of the foregoing hydrocarbon group having 1 to 20 carbon atoms is substituted with a halogen atom. Examples of the halogen atom include a fluorine atom, chlorine atom, and bromine atom.

In the polyorganosiloxane shown in the structural formula (1), $Y^1$ represents an organic group having at least one of a radical reactive group and a SH group. Examples of the radical reactive group include vinyl group, allyl group, γ-acryloxypropyl group, γ-metacryloxypropyl group, and γ-mercaptopropyl group.

In the polyorganosiloxane shown in the structural formula (1), $Y^2$ represents an organic group having an amino group and examples thereof include γ-aminopropyl group, N-β(aminoethyl)γ-aminopropyl group, and N-phenyl-γ-aminopropyl group.

In the polyorganosiloxane shown in the structural formula (1), $Z^1$ and $Z^2$ may be identical or different, and represent any one of a hydrogen atom, alkyl group, and group represented by the following structural formula (1-1).

Structural Formula (1-1)

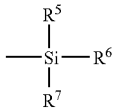

wherein $R^5$ and $R^6$ may be identical or different, and represent one of a hydrocarbon group having 1 to 20 carbon atoms and a halogenated hydrocarbon group having 1 to 20 carbon atoms; $R^7$ represents any one of a hydrocarbon group having 1 to 20 carbon atoms, a halogenated hydrocarbon group having 1 to 20 carbon atoms, and an organic group having at least one of a radical reactive group and a SH group. $R^5$, $R^6$, $R^7$ may be identical to $R^1$, $R^2$, $R^3$, $R^4$, and $Y^1$ represented in the structural formula (1).

In the structural formula (1), m is a positive integer of 10,000 or less and preferably 500 to 8,000, and n and p each are an integer of 1 or more and preferably 1 to 500.

The amino group-containing acryl-modified polyorganosiloxane of the present invention is a new compound. However, known documents can be referenced for a basic skeleton and a producing method, and polyorganosiloxanes and a producing method thereof described in Japanese Patent Application Publication (JP-B) No. 07-5808 can be applied for example. That is, the amino group-containing acryl-modified polyorganosiloxane of the present invention can be produced in the same manner as that in JP-B No. 07-5808 except using a polyorganosiloxane of the present invention represented by the structural formula (1) instead of a polyorganosiloxane of general formula (I).

The amino group-containing acryl-modified polyorganosiloxane of the present invention can be produced in the following manner. As raw materials, a cyclic polyorganosiloxane, a liquid polydimethylsiloxane whose terminals are capped with a hydroxyl group in the molecular chain, a liquid polydimethylsiloxane whose terminals are capped with an alkoxy group in the molecular chain, or a polydimethylsiloxane whose terminals are capped with a trimethylsilyl group in the molecular chain is mixed with a silane having at least one of a radical reactive group and SH group, followed by addition of an amino group-containing silane for reaction. By optionally changing the proportions of these raw materials, polyorganosiloxanes represented by the structural formula (1) with different contents of amino groups can be prepared.

The amino group-containing silane compounds are not particularly limited, and may be appropriately selected depending on the intended purpose. Examples thereof include compounds represented by the following structural formulae. Among these, 3-aminopropylmethyldiethoxysilane and 3-aminopropyldimethoxyethylsilane are particularly preferable.

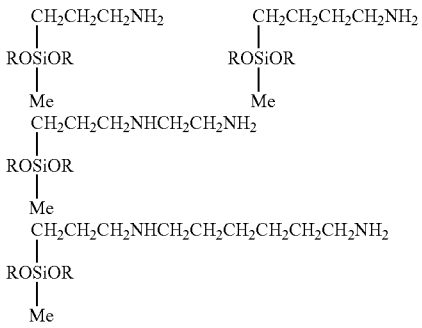

-continued

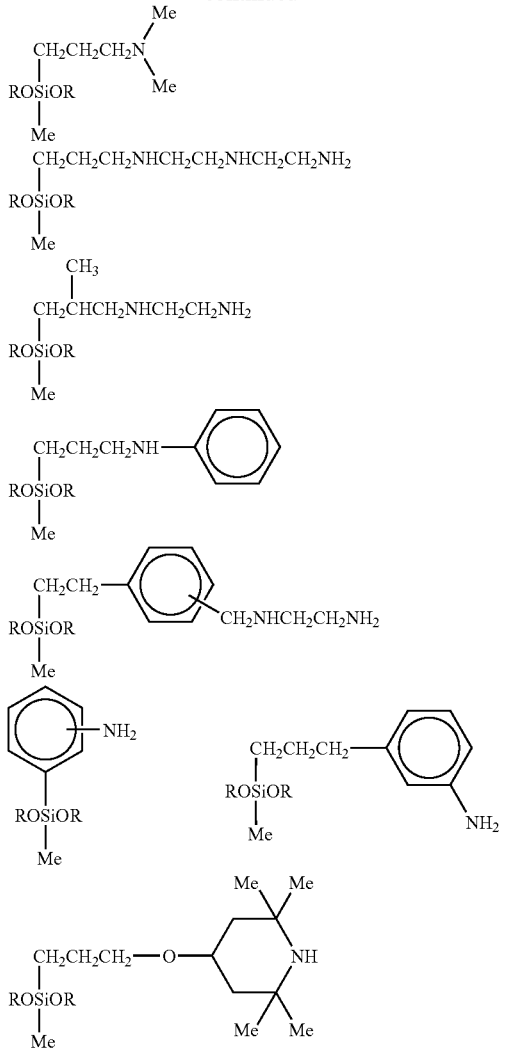

wherein R represents a methyl group or an ethyl group and Me represents a methyl group.

Next, the obtained polyorganosiloxane represented by the structural formula (1) is emulsion graft-copolymerized with an acrylic monomer to prepare the amino group-containing acryl-modified polyorganosiloxane of the present invention.

Since the obtained amino group-containing acryl-modified polyorganosiloxane includes a high proportion of an emulsifier, it needs to be sufficiently washed with water or alcohol before use. If the emulsifier resides in the polyorganosiloxane, it may cause adverse effect on the charge transportability as an electrophotographic photoconductor resulting in increased residual potential and reduced chargeability. Therefore, it is preferably to sufficiently wash away the emulsifier before use.

-Acrylic Monomer-

The acrylic monomer is not particularly limited and may be appropriately selected depending on the intended purpose as long as it can be graft-copolymerized with the polyorganosiloxane represented by the structural formula (1). Preferable examples include (meth)acrylates represented by the following structural formula (2), and mixtures of (meth)acrylate represented by the following structural formula (2) and monomers copolymerizable with the (meth)acrylates.

Structural Formula (2)

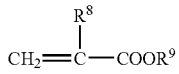

In the structural formula (2), $R^8$ represents one of a hydrogen atom and a methyl group.

$R^9$ represents any one of an alkyl group, alkoxy substituted-alkyl group, cycloalkyl group, and aryl group. These groups may further be substituted with one or more substituents.

Examples of the alkyl group include methyl group, ethyl group, propyl group, and butyl group.

Examples of the cycloalkyl group include cyclopentane group, cyclohexane group, and cycloheptane group.

Examples of the aryl group include phenyl group, tolyl group, xylyl group, and naphthyl group.

Examples of the (meth)acrylates represented by the structural formula (2) include alkyl(meth)acrylates such as methyl (meth)acrylate, ethyl(meth)acrylate, propyl(meth)acrylate, butyl(meth)acrylate, isobutyl (meth)acrylate, pentyl(meth) acrylate, hexyl(meth)acrylate, octyl (meth)acrylate, 2-ethylhexyl(meth)acrylate, lauryl(meth)acrylate and stearyl(meth) acrylate; alkoxy alkyl(meth)acrylates such as methoxyethyl (meth)acrylate, butoxyethyl(meth)acrylate; cyclohexyl (meth)acrylate, phenyl(meth)acrylate and benzyl(meth)acrylate. These may be used alone or in combination. Among these, methyl(meth)acrylate is particularly preferable.

Examples of the monomer copolymerizable with (meth) acrylate represented by the structural formula (2) include polyfunctional monomers and ethylenically-unsaturated monomers.

Examples of the polyfunctional monomer include polyfunctional monomer having a plurality of unsaturated groups, oxirane group-containing unsaturated monomers, hydroxyl group-containing unsaturated monomers, carboxyl group-containing ethylenically-unsaturated monomers, polyalkylene oxide group-containing unsaturated monomers, complete esters of polyalcohols and (meth)acrylic acid, ethylenically-unsaturated amide, alkylol or alkoxyalkyl compound of ethylenically-unsaturated amide, amino group-containing unsaturated monomer, and imide group-containing unsaturated monomer. These may be used alone or in combination.

Examples of the polyfunctional monomers having a plurality of unsaturated groups include 1,3,5,7-tetramethyl-3,5,7-trivinylcyclotetrasiloxypropylmethacrylate, tris(2-acryloyloxyethyl)isocianulate, trimethylolpropane triacrylate, pentaerythritol triacrylate, pentaerythritol tetraacrylate, dipentaerythritolhexaacrylate, and ditrimethylolpropane tetraacrylate.

Examples of the oxirane group-containing unsaturated monomers include glicidyl(meth)acrylate and glicidylallylether.

Examples of the oxirane group-containing unsaturated monomers include 2-hydroxyethyl(meth)acrylate and 2-hydroxypropyl(meth)acrylate.

Examples of the carboxyl group-containing ethylenically-unsaturated monomers include (meth)acrylic acid, maleic anhydride, crotonic acid, and itaconic acid.

Examples of the polyalkyleneoxide group-containing ethylenically-unsaturated monomers include (meth)acrylate ethyleneoxide, and propyleneoxide adducts.

Examples of complete esters of the polyalcohol and (meth) acrylic acid include complete esters of polyalcohols such as ethyleneglycoldi(meth)acrylate, diethyleneglycoldi(meth) acrylate and trimethylolpropanetri(meth)acrylate and (meth) acrylic acid.

Examples of the ethylenically-unsaturated amides include acrylamide, N-(1,1-dimethyl-3-oxobutyl)acrylamide, N,N-dimethylacrylamide, N-methylol(meth)acrylamide, N-butoxymethyl(meth)acrylamide, and N-methoxymethyl(meth) acrylamide.

Examples of the amino group-containing unsaturated monomers include N,N-dimethylaminoethylacrylate and N-diethylaminoethyl(meth)acrylate.

An example of the imide-containing unsaturated monomer includes acryloyloxyethylhexahydrophthalimide.

Among these, when forming a cross-linked resin layer by curing, addition of an amide and imide is effective in increasing the curing speed since they have an effect of reducing oxygen which consumes radicals generated. Besides, hexahydrophthalimide is especially effective for promoting cross-linking. These polyfunctional monomers have a function of providing elasticity, durability, heat resistance, etc., to a surface protective layer by being involved in cross-linking between polymers of an amino group-containing acryl-modified polyorganosiloxane.

Examples of the ethylenically-unsaturated monomers include styrene, α-methylstyrene, vinyltoluene, acrylonitrile, vinylchloride, vinylidenechloride, vinylacetate, vinylpropionate, and vinylversatate. These may be used alone or in combination. One or more of these ethylenically-unsaturated monomers and one or more of the polyfunctional monomers may also be combined together for use.

The mass ratio (C:D) between the (meth)acrylate (C) represented by the structural formula (2) and the monomer (D) copolymerizable with the (meth)acrylate is preferably 99.9:0.1 to 70:30 and more preferably 95:5 to 80:20. When the added amount of the monomer copolymerizable with the (meth)acrylate is greater than 30% by mass, tenacity and heat resistance of the amino group-containing acryl-modified polyorganosiloxane may be impaired. When it is less than 0.1% by mass, compatibility of the polyorganosiloxane with a binder resin may be impaired.

The mass ratio (A:B) between the polyorganosiloxane (A) represented by the structural formula (1) and the acrylic monomer (B) is preferably 40:60 to 80:20 and more preferably 50:50 to 75:25. When the proportion of the polyorganosiloxane used that is represented by the structural formula (1) is less than 40% by mass, lubricity-donating function from a polyorganosiloxane structure may be reduced and blade cleaning of the amino group-containing acryl-modified polyorganosiloxane may become difficult. When it is greater than 80% by mass, the glass transition temperature of the copolymer becomes too low and the copolymer may tend to be liquidized. Consequently, the surface of the photoconductor may tend to be adhesive, which may cause a problem such as adhesion of foreign substance.

Next, the production method of the amino group-containing acryl-modified polyorganosiloxane will be described.

The polyorganosiloxane represented by the structural formula (1) can be produced by reacting together the following ingredients: A cyclic polyorganosiloxane; a liquid polydimethylsiloxane whose both terminals are capped with a hydroxyl group in the molecular chain; a liquid polydimethylsiloxane whose terminals are capped with an alkoxy group in the molecular chain; a polydimethylsiloxane whose terminals are capped with a trimethylsilyl group in the molecular chain; a silane for introducing at least one of a radical reactive group and SH group or a hydrolyzed product thereof; an amino group-containing silane or hydrolyzed product thereof; and, further as necessary, a trialkoxysilane with three functional groups or hydrolyzed product thereof in an amount that never impairs the object of the present invention.

Another production method of the polyorganosiloxane represented by the structural formula (1) will be described.

The first method is to obtain a high-polymeric polyorganosiloxane by polymerizing such raw materials as a cyclic low molecular siloxane such as octamethylcyclotetrasiloxane, a dialkoxysilane compound having either or both of a radical reactive group and SH group or hydrolyzed product thereof, and an amino group-containing dialkoxysilane compound or hydrolytic product thereof under the presence of a strong base- or strong acid-catalyst. The obtained high-polymeric polyorganosiloxane is then subjected to emulsion dispersion in an aqueous medium under the presence of an appropriate emulsifier in order to make it ready for a subsequent step of emulsion graft copolymerization.

The second method is a method for emulsion polymerizing raw materials in an aqueous medium under the presence of sulfonate surfactants or sulfuric ester surfactants. The raw materials employed are a low molecular polyorganosiloxane, a dialkoxysilane compound having either or both of a radical reactive group or SH group or hydrolyzed product thereof, and an amino group-containing dialkoxysilane compound or hydrolyzed product thereof. In the emulsion polymerization, raw materials similar to those described above are polymerized by the addition of an appropriate amount of a strong base such as potassium hydroxide or sodium hydroxide after they have been emulsion dispersed in an aqueous medium using a cationic surfactant such as alkyltrimethylammoniumchloride or alkylbenzylammoniumchloride.

When the molecular weight of the obtained polyorganosiloxane represented by the structural formula (1) is small, it results in poor effect of imparting sustained tribological properties and abrasion resistance to a molded article obtained from the composition; therefore the polyorganosiloxane preferably has as large a molecular weight as possible. Hence, in the first method, it is necessary that the polyorganosiloxane have a high molecular weight in the polymerization reaction and then be subjected to emulsion-dispersion. In the second method, when the temperature of maturing treatment to be conducted after emulsion polymerization is low, the molecular weight of the polyorganosiloxane becomes large. Therefore, the maturing temperature is preferably 30° C. or less and more preferably 15° C. or less.

Emulsion graft copolymerization between the component of the structural formula (1) and the component of the structural formula (2) can be carried out by means of a known emulsion polymerization method using an aqueous emulsion of polyorganosiloxane as the component of the structural formula (1) and a normal radical initiator.

In the amino group-containing acryl-modified polyorganosiloxane of the present invention, residuals of impurities such as an emulsifier and coagulant employed during polymerization are preferably removed in accordance with necessity since they may impair electrical properties of the electrophotographic photoconductor where its electrical properties are important. Examples of the purification method include a method for stir-cleansing with such as acid solution, base solution, water and alcohol, and a solid-liquid extraction method such as a Soxhlet extraction.

The amino group-containing acryl-modified polyorganosiloxane is preferably dispersed in a particle state in the outermost layer. An average particle diameter of the amino group-containing acryl-modified polyorganosiloxane on the outermost layer is preferably 10 nm to 5,000 nm, and more preferably 50 nm to 500 nm.

The average particle diameter of the amino group-containing acryl-modified polyorganosiloxanes in the outermost layer can be determined, for example, by measurement of their sections with a transparent electron microscope (TEM).

The content of the amino group-containing acryl-modified polyorganosiloxanes in the outermost layer cannot be flatly specified since it may differ depending on the layer composition of the electrophotographic photoconductor; however, the content is preferably 0.2% by mass to 40% by mass and more preferably 1% by mass to 20% by mass.

When the content is less than 0.2% by mass, the silicon concentration in the surface of the photosensitive layer becomes deficient and cleanability may become poor. When it is greater than 40% by mass, mechanical properties of the surface of the photosensitive layer may become so soft that become more susceptible to abrasion.

<Layer Structure of Electrophotographic Photoconductor>

A layer structure of the electrophotographic photoconductor of the present invention is not particularly limited and may be appropriately selected depending on the intended purpose. In the first embodiment, the electrophotographic photoconductor contains a support and a photosensitive layer formed on the support, the photosensitive layer being the outermost layer.

In the second embodiment, the electrophotographic photoconductor contains a support, and a charge generating layer and a charge transporting layer are sequentially disposed on the support, the charge transporting layer being the outermost layer.

In the third embodiment, the electrophotographic photoconductor contains a support, and a photosensitive layer and a surface protective layer are sequentially disposed on the support, the surface protective layer being the outermost layer.

Thus, the outermost layer of the multilayered photosensitive layer is, for example, the charge transporting layer or the surface protective layer. The outermost layer in the single-layered photosensitive layer is, for example, the photosensitive layer or the surface protective layer.

Here, the layer structure of the electrophotographic photoconductor of the present invention will be explained with reference to the drawings. FIGS. 1 to 4 are schematic sectional views showing an example of an electrophotographic photoconductor.

In an embodiment shown in FIG. 1, a photosensitive layer 3 containing a charge generating material and a charge transporting material as a main component is disposed on a support 1.

Figure 2:
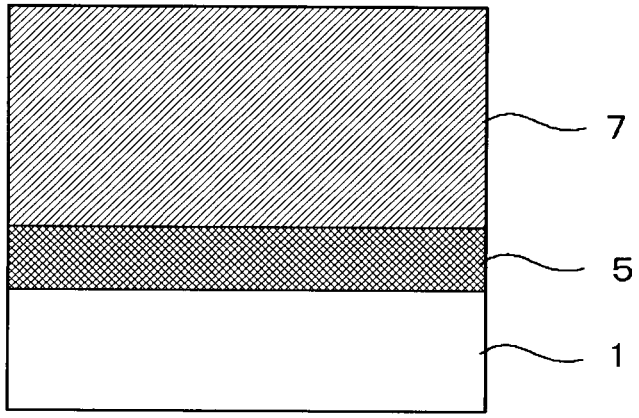
FIG. 2 is a schematic sectional view showing another example of the single-layered electrophotographic photoconductor of the present invention.

In an embodiment shown in FIG. 2, a charge generating layer 5 containing a charge generating material as a main component and a charge transporting layer 7 containing a charge transporting material as a main component are sequentially laminated on a support 1.

Figure 3:
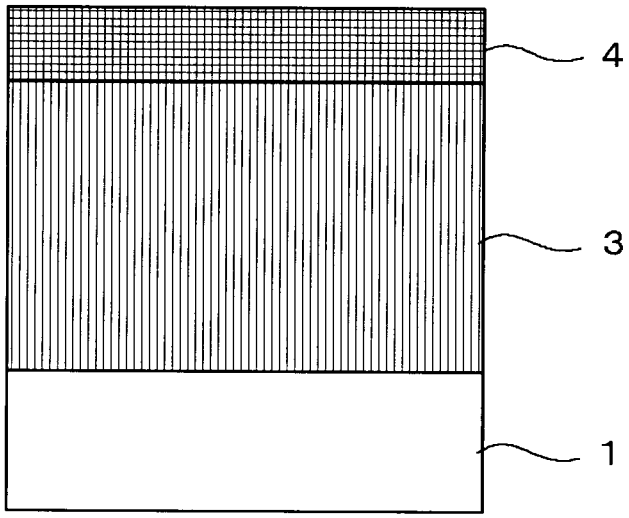
FIG. 3 is a schematic sectional view showing an example of the laminated electrophotographic photoconductor of the present invention.

In an embodiment shown in FIG. 3, a photosensitive layer 3 containing a charge generating material and charge transporting material as a main component is disposed on a support 1, and a surface protective layer 4 is further disposed on the photosensitive layer.

Figure 4:
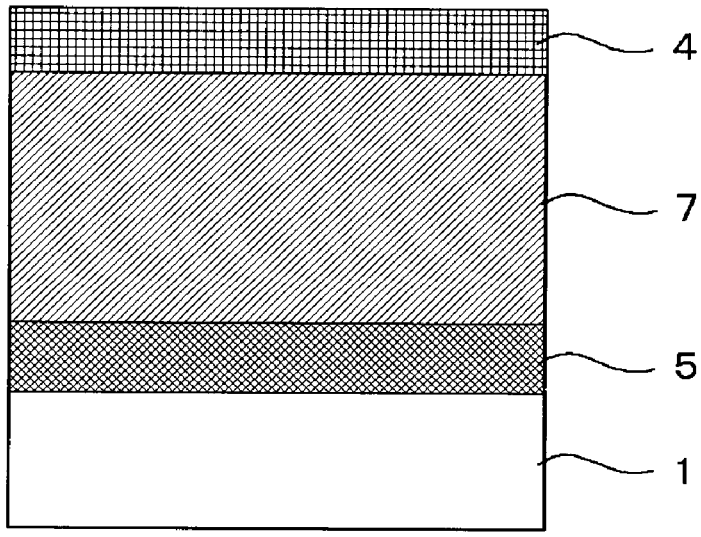
FIG. 4 is a schematic sectional view showing another example of the laminated electrophotographic photoconductor of the present invention.

In an embodiment shown in FIG. 4, a charge generating layer 5 containing a charge generating material as a main component, a charge transporting layer 7 containing a charge transporting material as a main component are laminated as a photosensitive layer on a support 1, and a surface protective layer 4 is further disposed thereon.

In the electrophotographic photoconductors shown in FIGS. 1 to 4, one or more undercoat layers may be disposed between the support 1 and the photosensitive layer 3 (or the charge generating layer 5). In the electrophotographic photoconductors shown in FIG. 3 and FIG. 4, an intermediate layer may be disposed between a photosensitive layer 3 (or a charge transporting layer 7) and a surface protective layer 4 in order to enhance adhesiveness therebetween. In the present invention, the amino group-containing acryl-modified polyorganosiloxane of the present invention is contained inside the outermost layers shown in FIGS. 1 to 4 or partially contained in the surface sides of the outermost layers shown in FIGS. 1 to 4.

[Multilayered Photosensitive Layer]

The multilayered photosensitive layer contains a charge generating layer containing a charge generating material as a main component and a charge transporting layer containing a charge transporting material as a main component.

-Charge Generating Layer-

The charge generating layer contains at least a charge generating material, also a binder resin, and further contains other components as necessary.

Inorganic and organic materials may be used as the charge generating materials.

Examples of the inorganic materials include crystalline selenium, amorphous selenium, selenium-tellurium, selenium-tellurium-halogen, selenium-arsenic compound, and amorphous-silicon. Preferred examples of the amorphous-silicon include those where dangling bonds are terminated by hydrogen atoms and halogen atoms, and those doped with boron atoms and/or phosphorus atoms.

The organic material is not particularly limited and may be appropriately selected depending on the intended purpose. Examples thereof include phthalocyanine pigments such as metal-free phthalocyanine and metal phthalocyanine, azulenium salt pigments, squaricate methin pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having a oxadiazole skeleton, azo pigments having a bisstylbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenylmethane pigments, triphenylmethane pigments, benzoquinone pigments, naphthoquinone pigments, cyanine pigments, azomethine pigments, indigoido pigments, and bisbenzimidazole pigments. These may be used alone or in combination.

Among these, azo pigments and phthalocyanine pigments are preferable. Azo pigments represented by the following structural formula (A) and titanilphthalocyanines (titanilphthalocyanine having a maximum diffraction peak at least at 27.2° as a diffraction peak (±0.2°) of a Bragg angle 2θ in Cu—Kα characteristic X-ray (wavelength=1.514 Å) diffractometry, and titanilphthalocyanine crystal having a maximum diffraction peak at least at 27.2° as a diffraction peak (±0.2°) of a Bragg angle 2θ in Cu—Kα ray (wavelength=1.542 Å), further having main peaks at 9.4°, 9.6° and 24.0°, having a peak at 7.3° as a diffraction peak at the lowest angle, not having any peak between the peak at 7.3° and the peak at 9.4°, furthermore not having any peak at 26.3°, and the average particle diameter of the primary particles is 0.25 μm or less) are particularly preferable.

Structural Formula (A)

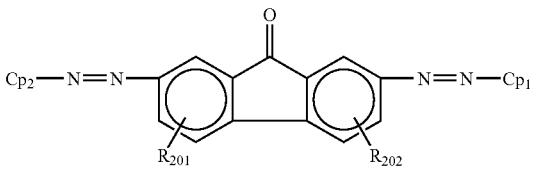

wherein $Cp_1$ and $Cp_2$ may be identical or different, and represent a coupler residual group; $R_{201}$ and $R_{202}$ may be identical or different, and represent any one of a hydrogen atom, alkyl group, alkoxy group, and cyano group. $Cp_1$ and $Cp_2$ are shown in the following structural formula (B).

Structural Formula (B)

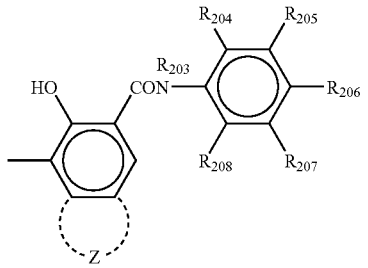

wherein $R_{203}$ represents a hydrogen atom, alkyl group such as methyl group or ethyl group, or aryl group such as phenyl group; $R_{204}$, $R_{205}$, $R_{206}$, $R_{207}$, and $R_{208}$ may be identical or different, and represent any one of a hydrogen atom, nitro group, cyano group, halogen atom, alkyl group, alkoxy group, dialkylamino group, and hydroxyl group; Z represents a substituted- or unsubstituted-aromatic carbon ring or a group of atoms required to constitute substituted or unsubstituted aromatic heterocyclic rings.

Examples of the halogen atom in $R_{204}$, $R_{205}$, $R_{206}$, $R_{207}$, and $R_{208}$ include a fluorine atom, chlorine atom, bromine atom, and iodine atom.

Examples of the alkyl groups include trifluoromethyl group, methyl group, and ethyl group.

Examples of the alkoxy groups include methoxy group, and ethoxy group.

The binder resins are not particularly limited and may be appropriately selected depending on the intended purpose. Examples thereof include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, and polyacrylamide resins. These may be used alone or in combination.

As the binder resins, in addition to the above-mentioned binder resins, polymer charge transporting materials with a charge transporting function, for example, (1) polymer materials such as polycarbonates, polyesters, polyurethanes, polyethers, polysiloxanes and acryl resins, all of which have an arylamine skeleton, benzidine skeleton, hydrazone skeleton, carbazole skeleton, stilbene skeleton or pyrazoline skeleton; (2) polymer materials having a polysilane skeleton, may be employed.

Specific examples of (1) the polymer materials include charge transporting materials described in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of (2) the polymer materials having a polysilane skeleton include polysilylene polymers described, for example, in JP-A Nos. 63-285552, 05-19497, 05-70595 and 10-73944, etc.

The charge generating layer may contain a low molecular charge transporting material.

Examples of the low molecular charge transporting materials include hole-transporting materials and electron-transporting materials.

Examples of the electron-transporting materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, 1,3,7-trinitrodibenzothiophene-5,5-dioxide, and diphenoquinone derivatives. These may be used alone or in combination.

Examples of the hole-transporting materials include oxazole derivatives, oxadiazole derivatives, imidazole derivatives, monoarylamine derivatives, diarylamine derivatives, triarylamine derivatives, stylbene derivatives, α-phenylstylbene derivatives, benzidin derivatives, diarylmethane derivatives, triarylmethane derivatives, 9-stylylanthracene derivatives, pyrazoline derivatives, divinylbenzene derivatives, hydrazone derivatives, indene derivatives, butadiene derivatives, pyrene derivatives, bisstylbene derivatives, enamine derivatives, and other known materials. These may be used alone or in combination.

The methods for forming the charge generating layer may be broadly classified into two methods: vacuum thin-film forming methods and casting methods using liquid dispersions. Examples of the vacuum thin-film forming methods include vacuum deposition, glow discharge electrolysis, ion plating, sputtering, reactive sputtering, and CVD processes. In the casting methods, firstly, the inorganic or organic charge generating materials and as necessary binder resins are dispersed in a solvent such as tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate or butyl acetate by means of a ball mill, ATTRITOR, sand mill, or bead mill. Then, the resultant dispersion liquid is appropriately diluted and applied to form a charge generating layer. Where appropriate, a leveling agent such as dimethyl silicone oil or methylphenyl silicone oil may be added to the dispersion liquid. The dispersion liquid may be applied by means of dip coating, spray coating, bead coating, or ring coating.

The thickness of the charge generating layer is not particularly limited, and may be appropriately selected depending on the intended purpose. It is preferably 0.01 μm to 5 μm and more preferably 0.05 μm to 2 μm.

-Charge Transporting Layer-

The charge transporting layer is designed so as to maintain charges, and transfer charges generated and separated by exposure from the charge generating layer so that they are coupled with the maintained charges. The charge transporting layer is required to have high electrical resistance in order to maintain charges. Moreover, the charge transporting layer is required to have a low dielectric constant and an appropriate charge transferring ability in order to obtain high surface potential by the maintained charges. When the charge transporting layer is the outermost layer, the amino group-containing acryl-modified polyorganosiloxane of the present invention is contained therein.

The following layers may be adopted as the charge transporting layer: layers in which a charge transporting material is dispersed in an appropriate binder resin; layers containing a high molecular charge transporting material having a structure that develops a charge transporting function; and resin layers in which a monomer having a structure that develops charge transporting function and another monomer component(s) is three-dimensionally crosslinked and cured.

Examples of the charge transporting materials include hole-transporting materials, electron-transporting materials, and high molecular charge transporting materials.

Examples of the electron-transporting materials (electron-accepting materials) include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, and 1,3,7-trinitrodibenzothiophene-5,5-dioxide. These may be used alone or in combination.

Examples of the hole-transporting materials (electron-donating materials) include poly-N-vinylcarbazole or derivatives thereof, poly-γ-carbazolylethylglutamate or derivatives thereof, pyrene-formaldehyde condensation or derivatives thereof, polyvinyl pyrene, polyvinylphenanthrene, polysilane, oxazole derivatives, oxadiazole derivatives, imidazole derivatives, monoarylamine derivatives, diarylamine derivatives, triarylamine derivatives, stylbene derivatives, α-phenylstylbene derivatives, benzidin derivatives, diarylmethane derivatives, triarylmethane derivatives, 9-stylylanthracene derivatives, pyrazoline derivatives, divinylbenzene derivatives, hydrazone derivatives, indene derivatives, butadiene derivatives, pyrene derivatives, bisstylbene derivatives, and enamine derivatives. These may be used alone or in combination.

The binder resins are not particularly limited and may be appropriately selected depending on the intended purpose. Examples thereof include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyacrylate resins, phenoxy resins, polycarbonate resins, acetylcellulose resins, ethylcellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenol resins, and alkyd resins. The content of the charge transporting material is preferably 20 parts by mass to 300 parts by mass and more preferably 40 parts by mass to 150 parts by mass relative to 100 parts by mass of the binder resin.

Examples of the high molecular charge transporting materials include materials having the following structures. Examples of (a) polymers having a carbazole ring include poly-N-vinylcarbazole and compounds described in JP-A Nos. 50-82056, 54-9632, 54-11737, 04-175337, 04-183719 and 06-234841.

Examples of (b) polymers having a hydrazone structure include compounds described in JP-A Nos. 57-78402, 61-20953, 61-296358, 01-134456, 01-179164, 03-180851, 03-180852, 03-50555, 05-310904 and 06-234840.

Examples of (c) polysilylene polymers include compounds described in JP-A Nos. 63-285552, 01-88461, 04-264130, 04-264131, 04-264132, 04-264133, and 04-289867.

Examples of (d) polymers having a triarylamine structure include N,N-bis(4-methylphenyl)-4-aminopolystyrene and compounds described in JP-A Nos. 01-134457, 02-282264, 02-304456, 04-133065, 04-133066, 05-40350, and 05-202135.

Examples of (e) other polymers include formaldehyde condensed polymers of nitropyrene and compounds described in JP-A Nos. 51-73888, 56-150749, 06-234836, and 06-234837.

In addition to those mentioned above, examples of the polymer charge transporting materials include polycarbonate resins, polyurethane resins, polyester resins and polyether resins, all of which have a triarylamine structure. Examples of the polymer charge transporting materials include compounds described in JP-A Nos. 64-1728, 64-13061, 64-19049, 04-11627, 04-225014, 04-230767, 04-320420, 05-232727, 07-56374, 09-127713, 09-222740, 09-265197, 09-211877, and 09-304956.

As a polymer having an electron donating group, in addition to the above-mentioned polymers, copolymers with known monomers, block polymers, graft polymers, star polymers, and further, for example, cross-linked polymers having an electron donating group as described in JP-A No. 03-109406 may be employed.

As the charge transporting layer, a resin layer in which a monomer having a structure that develops charge transporting function and another monomer component(s) is three-dimensionally crosslinked and cured. As the resin layer, cross-linked resin layers that utilized various crosslinking reactions may be employed. Examples thereof include those that utilized a condensation reaction between an isocyanate group and hydroxyl group; those that utilized a condensation reaction between a silanol group and hydroxyl group; and those that utilized a radical chain polymerization reaction of an acryl group; however, any kind of known cross-linking reactions may be employed.

The charge transporting layer can be formed by dissolving and/or dispersing these charge transporting materials and the binder resins in an appropriate solvent, applying and drying the resultant solution. In addition to the charge transporting materials and the binder resins, an appropriate amount of additive agents such as plasticizers, antioxidants, and leveling agents may also be added to the charge transporting layer as necessary.

Examples of solvents that are used for application of the charge transporting layer include solvents used for the charge generating layer, and solvents which can favorably dissolve charge transporting material and binder resin are appropriate. These solvents may be used alone or in combination. The charge transport layer may be formed with the same method as that for the charge generating layer 35.

A plasticizer and a leveling agent may also be added according to requirements.

Regarding the plasticizer, a plasticizer which is generally used for a resin such as dibutylphthalate and dioctylphthalate may be used. The appropriate amount is zero parts by mass to 30 parts by mass with respect to 100 parts by mass of the binder resin.

Examples of the leveling agent include silicone oils such as dimethyl silicone oil and methylphenyl silicone oil as well as a polymer and an oligomer having a perfluoroalkyl group in their side chain. The appropriate amount is zero parts by mass to one part by mass with respect to 100 parts by mass of the binder resin.

The thickness of the charge transporting layer is not particularly limited and may be appropriately selected depending on the intended purpose. It is preferably 5 μm to 40 μm and more preferably 10 μm to 30 μm.

[Single-Layered Photosensitive Layer]

The single-layered photosensitive layer can be formed by applying a coating solution in which a charge generating material, a charge transporting material and a binder resin are dissolved and/or dispersed in a solvent such as tetrahydrofuran, dioxane, dichloroethane and cyclohexane, and drying the resultant coating solution. A plasticizer, leveling agent, or antioxidant agent may also be added according to requirements.

The coating solution may be applied by means of dip coating, spray coating, bead coating, or ring coating.

When the single-layered photosensitive layer is an outermost layer, the amino group-containing acryl-modified polyorganosiloxane of the present invention is contained in the photosensitive layer As the binder resin, a binder resin exemplified in the charge transporting layer and a binder resin exemplified in the charge generating layer may be combined together for use, and a high molecular charge transporting material may also be favorably employed. The content of the charge generating material is preferably 5 parts by mass to 40 parts by mass relative to 100 parts by mass of the binder resin. The content of the charge transporting material is preferably zero parts by mass to 190 parts by mass and more preferably 50 parts by mass to 150 parts by mass. The thickness of the single-layered photosensitive layer is not particularly limited and may be appropriately selected depending on the intended purpose. It is preferably 5 μm to 40 μm.

[Surface Protective Layer]

The surface protective layer is the outermost layer formed on a photosensitive layer to improve abrasion resistance while maintaining functions of the photosensitive layer of the photoconductor and is not particularly limited and may be appropriately selected depending on the intended purpose.

Examples thereof include (1) a surface protective layer containing a single layer made of binder resin used in a photosensitive layer, (2) a surface protective layer containing a layer in which an inorganic filler is dispersed in a composition of the same as the photosensitive layer, and (3) a surface protective layer containing a three-dimensionally crosslinked resin layer having a charge transporting function.

Among these, (1) the surface protective layer containing the single layer of binder resin tends to generate residual potential of a photoconductor since it has no charge transporting materials, and thus it is not preferable. Besides, the surface protective layer may also be a thin film with a thickness of 2 μm or less; however, it is necessary to add the amino group-containing acryl-modified polyorganosiloxane of the present invention to the surface protective layer in a dispersed manner. Therefore, too thin films are not preferable since they induce deterioration of sustainability.

In contrast, the surface protective layer in which a filler is dispersed in a composition of the same as the photosensitive layer (2), and the surface protective layer containing a three-dimensionally crosslinked resin layer having charge transporting function (3) are preferable since they can favorably contain the amino group-containing acryl-modified polyorganosiloxane of the present invention.

When the electrophotographic photoconductor of the present invention includes a surface protective layer as the outermost layer, the surface protective layer containing the amino group-containing acryl-modified polyorganosiloxane of the present invention.

The fillers employed in (2) the surface protective layer may be broadly classified into two fillers: organic fillers and inorganic fillers.

Examples of the organic filler materials include fluorine resin powders such as polytetrafluoroethylene, silicone resin powders, and carbon powders.

Examples of the inorganic filler materials include metal powders such as copper, tin, aluminum and indium; metal oxides such as silica, tin oxide, zinc oxide, titanium oxide, indium oxide, antimony oxide, bismuth oxide, antimony doped tin oxide and tin doped indium oxide; and potassium titanate. Among these, in view of filler hardness, it is effective to employ inorganic materials and particularly, metal oxides are favorable. For a high quality imaging, it is important to control bulk resistance of the surface protective layer. When the resistance is too small, image deletion may tend to occur, whereas when the resistance is too high, an increase of the exposed area potential may be an issue. To solve these problems, silicon oxide, aluminum oxide, titanic oxide, and tin oxide may be effectively employed.

The average primary particle diameter of the filler is preferably 0.01 μm to 0.5 μm. When the average primary particle diameter thereof is 0.01 μm or less, abrasion resistance and dispersibility of the filler may be reduced. When it is greater than 0.5 μm, sedimentation of the filler in dispersion may be promoted and filming of the toner is likely to occur.

An advantageous point is that the higher the concentration of the filler material in the surface protective layer is, the higher abrasion resistance it is. However, an excessively high concentration of the filler material may cause adverse effects such as increases in residual potential and reductions in recording light transmittance of the protective layer. Hence, it is generally preferable 50% by mass or less and more preferably 30% by mass or less relative to the total solid content thereof.

The filler can be subjected to a surface treatment with at least one surface treatment agent. This treatment is preferable from the viewpoint of filler dispersibility. A reduction in filler dispersibility may cause not only an increase in residual potential but also a reduction in transparency of the coated film and occurrences of film defect, and further cause a reduction in abrasion resistance, which may cause a serious problem that prevents achievement of high durability or high quality imaging. As the surface treatment agent, any conventionally used surface treatment agent may be employed; however, a surface treatment agent capable of maintaining insulability of the filler is preferable. For example, titanate coupling agents, aluminum coupling agents, zircoaluminate coupling agents, higher fatty acids, and a mixture thereof with silane coupling agents, $Al_2O_3$, $TiO_2$, $ZrO_2$, silicone, aluminum stearate, and mixtures thereof are more preferably in view of filler dispersibility and grainy image. A surface treatment with a silane coupling agent may cause further occurrences of image blur, however, the occurrences of image blur may be prevented with use of a mixture of the surface treatment agents and the silane coupling agents for the surface treatment. The amount of the surface treatment agent to be added cannot be flatly specified because it may vary depending on the average primary particle diameter of the filler used; however, it is preferably 3% by mass to 30% by mass and more preferably 5% by mass to 20% by mass. When the amount of the surface treatment agent is less than 3% by mass, the filler dispersion effect may not be obtained. When it is greater than 30% by mass, it may cause significant increases in residual potential. These filler materials may be used alone or in combination.

The three-dimensionally crosslinked resin layer having charge transporting function (3) is a layer in which a charge transporting material having a polymerizable reactive group, and a monomer component or a resin component that is crosslinking reactive with the charge transporting material are three-dimensionally crosslinked by utilizing heat curing reaction or light curing reaction; and is a macromoleculed resin layer that is insoluble to a solvent.

When the three-dimensionally crosslinked resin layer contains an acrylic curable resin layer having a charge transporting function, it is possible to provide an electrophotographic photoconductor that has favorable dispersibility of the amino group-containing acryl-modified polyorganosiloxane of the present invention, that does not reduce mechanical properties of the surface protective layer due to dispersion, that can achieve excellent cleanability in a low temperature and low humidity environment, and that has excellent durability.

The acrylic curable resin is a resin in which a coating material containing at least a chain-polymerizable charge transporting compound having one or more of chain-polymerizable functional group in a molecule (Component A) and a chain-polymerizable compound having three or more functional groups (Component B) were reacted by radical reaction initiating means such as heat, light-irradiation, electron irradiation or radiation irradiation and were three-dimensionally crosslinked.

-hain-Polymerizable Charge Transporting Compound (Component A)-

The compound (Component A) is not particularly limited and may be appropriately selected depending on the intended purpose as long as those in which a charge transporting structure is substituted with a chain-polymerizable functional group.

Examples of the chain-polymerizable functional groups of the chain-polymerizable charge transporting compounds include a vinyl group, styryl group, 2-methyl-1,3-butadienyl group, vinylcarbonyl group, acryloyloxy group, acryloylamido group, vinylthioether group, α-chloroacryloyloxy group, methacryloyloxy group, α-cyanoethylene group, α-cyanoacryloyloxy group, α-cyanophenylene group, methacryloylamino group, cyclic carbonyl, and oxirane. Among these, acryloyloxy group and methacryloyloxy group are particularly preferable.

Specific examples of the charge transporting structure of the chain-polymerizable charge transporting compound (Component A) are as follows. The Component A has the following structure in which a chain-polymerizable functional group is substituted therewith.

Examples of the Component A include poly-N-carbazole or derivatives thereof, poly-γ-carbazolylethylglutamate or derivatives thereof, pyrene-formaldehyde condensation or derivatives thereof, polyvinylpyrene, polyvinylphenanthrene, oxazole derivatives, imidazole derivatives, triphenylamine derivatives, or compounds represented by the following structural formula (2).

Structural Formula (3)

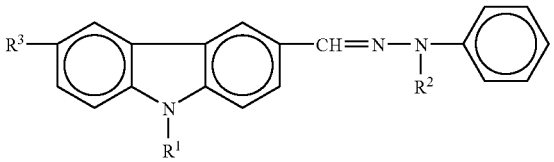

wherein $R^1$ represents any one of a methyl group, ethyl group, 2-hydroxyethyl group, and 2-chloroethyl group; $R^2$ represents any one of an methyl group, ethyl group, benzyl group, and phenyl group; and $R^3$ represents any one of a hydrogen atom, chlorine atom, bromine atom, alkyl group having 1 to 4 carbon atoms, alkoxy group having 1 to 4 carbon atoms, dialkylamino group, and nitro group.

Examples of compounds represented by the structural formula (2) include 9-ethylcarbazole-3-carboaldehyde-1-methyl-1-phenylhydrazone, 9-ethylcarbazole-3-carboaldehyde-1-benzyl-1-phenylhydrazone, and 9-ethylcarbazole-3-carboaldehyde-1,1-diphenylhydrazone.

Structural Formula (4)

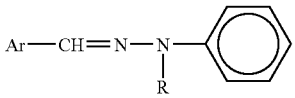

wherein Ar represents any one of a naphthalene ring, anthracene ring, pyrene ring, substitution thereof, pyridine ring, furan ring, and thiophen ring; and R represents any one of an alkyl group, phenyl group, and benzyl group.

Examples of compounds represented by the structural formula (4) include 4-diethylaminostyryl-β-carboaldehyde-1-methyl-1-phenylhydrazone and 4-methoxynaphthalene-1-carboaldehyde-1-benzyl-1-phenylhydrazone.

Structural Formula (5)

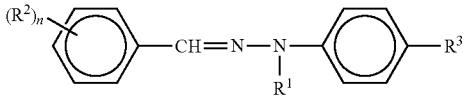

wherein $R^1$ represents any one of an alkyl group, benzyl group, phenyl group, and naphthyl group; $R^2$ represents any one of a hydrogen atom, alkyl group having 1 to 3 carbon atoms, alkoxy group having 1 to 3 carbon atoms, dialkylamino group, diaralkylamino group, and diarylamino group; n represents an integer of 1 to 4; $R^2$ may be the same or different when n is 2 or more; and $R^3$ represents a hydrogen atom or methoxy group.

Examples of compounds represented by the structural formula (5) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

Structural Formula (6)

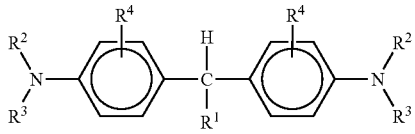

wherein $R^1$ represents any one of an alkyl group having 1 to 11 carbon atoms, phenyl group which may be substituted, and heterocyclic group; $R^2$ and $R^3$ may be identical or different, and represent any one of an alkyl group having 1 to 4 carbon atoms, hydroxyalkyl group, chloroalkyl group, and aralkyl group which may be substituted; $R^2$ and $R^3$ may be bonded together to form a heterocyclic containing a nitrogen; and $R^4$ may be identical or different, and represents any one of a hydrogen atom, alkyl group having 1 to 4 carbon atoms, alkoxy group, and halogen atom.

Examples of compounds represented by the structural formula (6) include 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)-triphenylmethane.

Structural Formula (7)

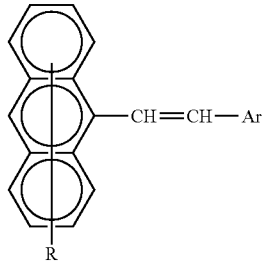

wherein R represents one of a hydrogen atom and halogen atom; and Ar represents any one of a phenyl group which may be substituted, naphthyl group, anthryl group, and carbazolyl group.

Examples of compounds represented by the structural formula (7) include 9-(4-diethylaminostyryl)anthracene and 9-brom-10-(4-diethylaminostyryl)anthracene.

Structural Formula (8)

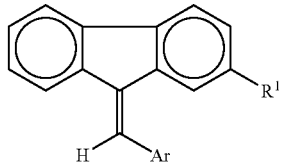

wherein $R^1$ represents any one of a hydrogen atom, halogen atom, cyano group, alkoxy group having 1 to 4 carbon atoms, and alkyl group having 1 to 4 carbon atoms; and Ar represents one of the following structural formula (9) and the following structural formula (10), Structural Formula (9)

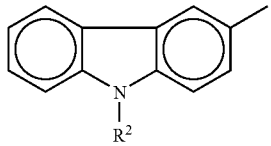

Structural Formula (10)

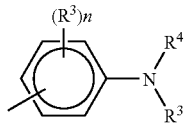

wherein $R^2$ represents an alkyl group having 1 to 4 carbon atoms; $R^3$ represents any one of a hydrogen atom, halogen atom, alkyl group having 1 to 4 carbon atoms, alkoxy group having 1 to 4 carbon atoms, and dialkylamino group; n represents an integer of 1 or 2; $R^3$ may be identical or different when n is 2; and $R^4$ and $R^5$ each represent any one of a hydrogen atom, alkyl group which may have a substituent having 1 to 4 carbon atoms, and benzyl group which may be substituted.

Examples of compounds represented by the structural formula (8) include 9-(4-dimethylaminobenzylidene)-fluorene and 3-(9-fluorenilidene)-9-ethylcarbazole.

Structural Formula (11)

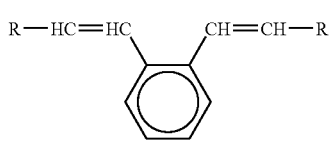

wherein R represents any one of a carbazolyl group, pyridyl group, thienyl group, indolyl group, furyl group, phenyl group which may be independently substituted or unsubstituted, styryl group, naphthyl group, and anthryl group, and these substituents represent a group selected from dialkylamino group, alkyl group, alkoxy group, carboxy group or esters thereof, halogen atom, cyano group, aralkylamino group, N-alkyl-N-aralkylamino group, amino group, nitro group, and acetylamino group.

Examples of compounds represented by the structural formula (11) include 1,2-bis(4-diethylaminostyryl)benzene and 1,2-bis(2,4-dimethoxystyryl)benzene.

Structural Formula (12)

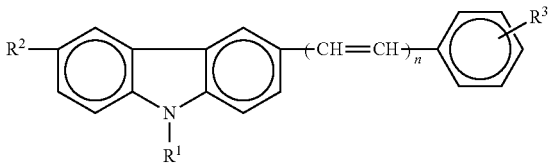

wherein $R^1$ represents any one of a lower alkyl group, phenyl group which may be substituted, and benzyl group; $R^2$ and $R^3$ each represent any one of a hydrogen atom, lower alkyl group, lower alkoxy group, halogen atom, nitro group, amino group, and amino group which may be substituted with a lower alkyl group or a benzyl group; and n represents an integer of 1 or 2.

Examples of compounds represented by the structural formula (12) include 3-styryl-9-ethylcarbazole and 3-(4-methoxystyryl)-9-ethylcarbazole.

Structural Formula (13)

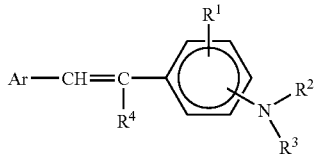

wherein $R^1$ represents any one of a hydrogen atom, alkyl group, alkoxy group, and halogen atom; $R^2$ and $R^3$ each represent an aryl group which may be substituted; $R^4$ represents any one of a hydrogen atom, lower alkyl group, and phenyl group which may be substituted; and Ar represents one of a phenyl group which may be substituted or naphthyl group.

Examples of compounds represented by the structural formula (13) include 4-diphenylaminostylbene, 4-dibenzylaminostylbene, 4-ditrylaminostylbene, 1-(4-diphenylaminostyryl)naphthalene, and 1-(4-diphenylaminostyryl) naphthalene.

Structural Formula (14)

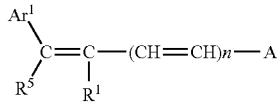

wherein n represents an integer of 0 or 1; $R^1$ represents any one of a hydrogen atom, alkyl group, and phenyl group which may be substituted; $Ar^1$ represents an aryl group which may be substituted or unsubstituted; $R^5$ represents one of a alkyl group containing a substituted alkyl group and an aryl group which may be substituted; A represents any one of a group represented by the following structural formula (15), 9-anthryl group, and carbazolyl group which may be substituted; and $R^2$ represents any one of a hydrogen atom, alkyl group, alkoxy group, halogen atom, and a group represented by the following structural formula (16), and may be identical or different when m is 2 or more. When n is 0, A and $R^1$ may form a shared ring.

Structural Formula (15)

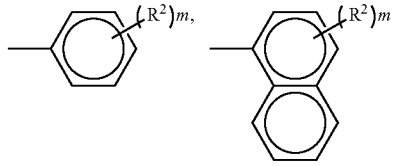

Structural Formula (16)

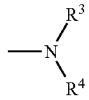

wherein $R^3$ and $R^4$ each represent an aryl group which may be substituted, and may be identical or different. $R^4$ may form a ring.

Examples of compounds represented by the structural formula (14) include 4'-diphenylamino-α-phenylstylbene and 4'-bis(4-methylphenyl)amino-α-phenylstylbene.

Structural Formula (17)

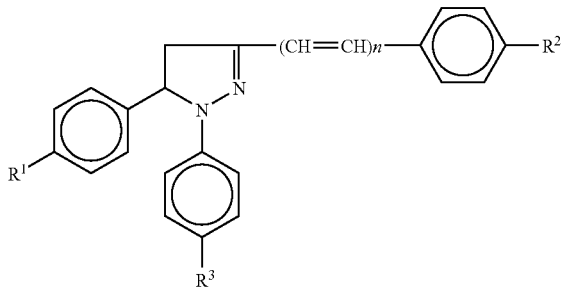

wherein $R^1$, $R^2$, and $R^3$ each represent a hydrogen atom, lower alkyl group, lower alkoxy group, halogen atom, and dialkylamino group; and n represents an integer of 0 or 1.

An example of compounds represented by the structural formula (17) includes 1-phenyl-3-(4-diethylaminostyryl)-5-(4-diethylaminophenyl)pyrazoline.

Structural Formula (18)

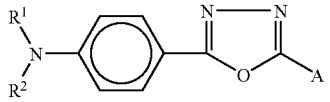

wherein $R^1$ and $R^2$ each represent one of an alkyl group containing a substituted alkyl group and aryl group which may be substituted or unsubstituted; and A represents any one of a substituted amino group, aryl group which may be substituted or unsubstituted, and allyl group.

Examples of compounds represented by the structural formula (18) include 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Structural Formula (19)

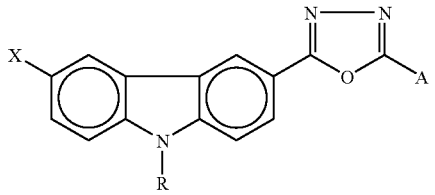

wherein X represents any one of a hydrogen atom, lower alkyl group, and halogen atom; R represents one of an alkyl group containing a substituted alkyl group, and aryl group which may be substituted; and A represents one of a substituted amino group and aryl group which may be substituted.

Examples of compounds represented by the structural formula (19) include 2-N,N-diphenylamino-5-(N-ethylcarbazole-3-yl)-1,3,4-oxadiazole and 2-(4-diethylaminophenyl)-5-(N-ethylcarbazole-3-yl)-1,3,4-oxadiazole.

Structural Formula (20)

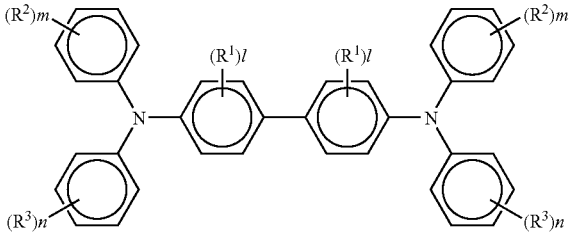

wherein $R^1$ represents any one of a lower alkyl group, lower alkoxy group, and halogen atom; $R^2$ and $R^3$ may be identical or different, and each represents a hydrogen atom, lower alkyl group, lower alkoxy group, and halogen atom; and l, m, and n each represent an integer of 0 to 4.

Examples of benzidin compounds represented by the structural formula (20) include N,N'-diphenyl-N,N'-bis(3-methylphenyl)-[1,1'-biphenyl]-4,4'-diamine and 3,3'-dimethyl-N,N,N',N'-tetrakis(4-methylphenyl)-[1,1'-biphenyl]-4,4'-diamine.

Structural Formula (21)

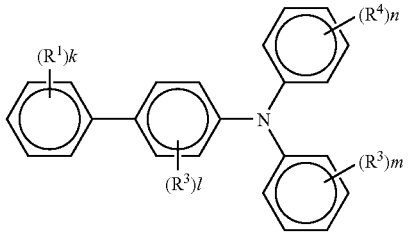

wherein $R^1$, $R^3$, and $R^4$ each represent any one of a hydrogen atom, amino group, alkoxy group, thioalkoxy group, aryloxy group, methylenedioxy group, alkyl group which may be substituted, aryl group which may have a halogen atom or substituent; and $R^2$ represents any one of a hydrogen atom, alkoxy group, alkyl group which may by substituted, and halogen atom. The case where $R^1$, $R^2$, $R^3$, and $R^4$ are all hydrogen is excluded. k. l, m, and n each are an integer of 1, 2, 3, or 4 and, when each thereof is an integer of 2, 3, or 4, the $R^1$, $R^2$, $R^3$, and $R^4$ may be identical or different.

Examples of biphenylamine compounds represented by the structural formula (21) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

Structural Formula (22)

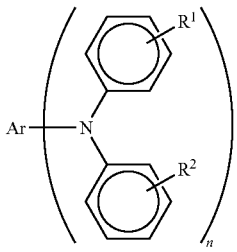

wherein Ar represents a condensed polycyclic hydrocarbon group having 18 or less carbon atoms, which may be substituted; and $R^1$ and $R^2$ each represent any one of a hydrogen atom, halogen atom, alkyl group which may by substituted, alkoxy, and phenyl which may be substituted. $R^1$ and $R^2$ may be identical or different. n represents an integer of 1 or 2.

Examples of triarylamine compounds represented by the structural formula (22) include N,N-diphenyl-pyrene-1-amine, N,N-di-p-tryl-pyrene-1-amine, N,N-di-p-tryl-1-naphthylamine, N,N-di(p-tryl)-1-phenanthrylamine, 9,9-dimethyl-2-(di-p-trylamino)fluorene, N,N,N',N'-tetrakis(4-methylphenyl)-phenanthrene-9,10-diamine, and N,N,N',N'-tetrakis(3-methylphenyl)-m-phenylenediamine.

A-CH═CH—Ar—CH═CH-A Structural Formula (23)

wherein Ar represents an aromatic hydrocarbon group which may be substituted; A represents a group represented by the following structural formula (24).

Structural Formula (24)

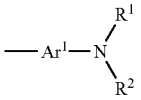

wherein Ar' represents an aromatic hydrocarbon group which may be substituted; and $R^1$ and $R^2$ each represent an alkyl group which may be substituted, and aryl group which may be substituted.

Examples of diolefin aromatic compounds represented by the structural formula (23) include 1,4-bis(4-diphenylaminostyryl)benzene, and 1,4-bis[4,-di(p-tryl)aminostyryl]benzene.

Structural Formula (25)

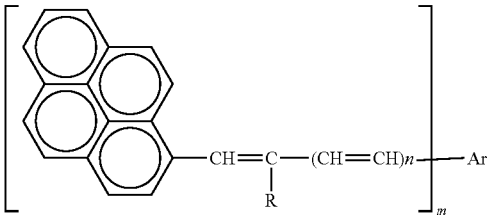

wherein Ar represents an aromatic hydrocarbon group which may be substituted; R represents one of an alkyl group which may be substituted, and aryl group which may be substituted; n is an integer of 0 or 1; and m is an integer of 1 or 2. When n is 0 and m is 1, Ar and R may form a shared ring.

Examples of styrylpyrene compounds represented by the structural formula (25) include 1-(4-diphenylaminostyryl) pyrene and 1-(N,N-di-p-tryl-4-aminostyryl)pyrene.

Examples of other electron-transporting materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophene-4-on, and 1,3,7-trinitrodibenzothiophene-5,5-dioxide.

Furthermore, electron-transporting materials represented by the following structural formula (26), (27), (28), and (29) are favorable for use.

Structural Formula (26)

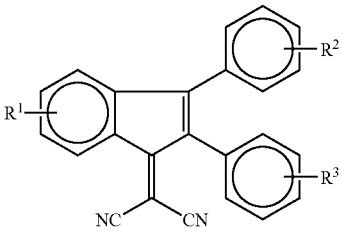

wherein $R^1$, $R^2$, and $R^3$ each represent any one of a hydrogen atom, halogen atom, alkyl group which may by substituted, alkoxy, and phenyl which may be substituted, and may be identical or different.

Structural Formula (27)

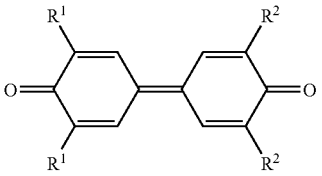

wherein $R^1$ and $R^2$ each represent any one of a hydrogen atom, alkyl group which may by substituted, and phenyl which may be substituted, and may be identical or different.

Structural Formula (28)

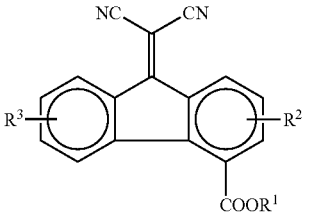

wherein $R^1$, $R^2$, and $R^3$ each represent any one of a hydrogen atom, halogen atom, alkyl group which may by substituted, alkoxy, and phenyl which may be substituted, and may be identical or different.

Structural Formula (29)

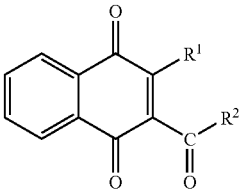

wherein $R^1$ represents one of an alkyl group which may be substituted, and aryl group which may be substituted; $R^2$ represents one of an alkyl group which may be substituted, aryl group which may be substituted, and —O—$R^3$, wherein $R^3$ represents one of an alkyl group which may be substituted, and aryl group which may be substituted.

Among above-mentioned specific examples of the charge transporting structure in the chain-polymerizable charge transporting compound (Component A), examples of the structural formula (14), (20), and (21) are preferable structures.

An example of the charge transporting structure in the chain-polymerizable charge transporting compound (Component A) includes compounds represented by the following structural formula (i).

Structural formula (i)

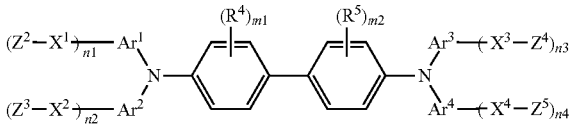

wherein $Ar^1$ to $Ar^4$ each represent an alkylene group which may be substituted, bivalent arylene group which may be substituted, and may be identical or different; $R^4$ and $R^5$ each represent an alkyl group, alkoxy group, and halogen atom; $X^1$ to $X^4$ each represent any one of an oxygen atom, sulfur atom, alkylene group which may be substituted, bivalent arylene group which may be substituted, and combined bivalent group thereof; $Z^2$ to $Z^5$ each represent a chain-polymerizable functional group; and n1 to n4 each represent an integer of 0 to 5. Compounds represented by the structural formula (i) must contain at least one chain-polymerizable functional group. m1 and m2 each represent an integer of 0 to 4.

Furthermore, an example of the charge transporting structure in the chain-polymerizable charge transporting compound (Component A) includes compounds represented by the following structural formula (ii).

Structural Formula (ii)

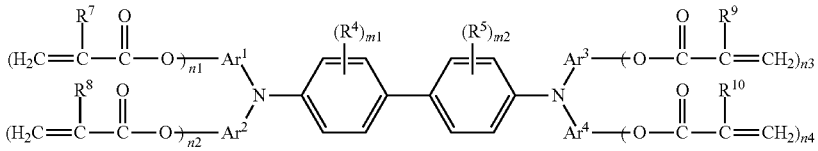

wherein $A^1$ to $Ar^4$, $R^4$, and $R^5$ each represent the same as those in the structural formula (i); and $R^7$ to $R^{10}$ each represent a methyl group or hydrogen atom; nil to n4 each represent an integer of 0 to 5. Compounds represented by the structural formula (ii) must contain at least one chain-polymerizable functional group. m1 and m2 each represent an integer of 0 to 4.

Furthermore, examples of the chain-polymerizable charge transporting compound (Component A) include chain-polymerizable charge transporting compounds having a charge transporting structure described in JP-A Nos. 2005-227761, 2004-212959, 2004-258346, 2001-175016.

-Chain-Polymerizable Compound Having Three or More Functional Groups (Component B)-

The chain-polymerizable compound having three or more functional groups (Component B) means a monomer not containing a hole transporting structure such as triarylamine, hydrazone, pyrazoline and carbazole, and a charge transporting structure (or a group that represents a charge transporting structure) such as an electron attractive aromatic ring having, for example, condensed polycyclic quinone, diphenoquinone, cyano group, and nitro group; and containing three or more chain-polymerizable functional groups. A chain-polymerizable functional group of the chain-polymerizable compound (Component B) may be the same as those described in the Component A.

The chain-polymerizable compound with three or more functional groups (Component B) is not particularly limited and may be appropriately selected depending on the intended purpose. Examples thereof include trimethylolpropane triacrylate (TMPTB), trimethylolpropane trimethacrylate trimethylolpropane alkylene-modified triacrylate, trimethylolpropane ethyleneoxy-modified (hereinafter may be referred to as "EO-modified")triacrylate, trimethylolpropa propyleneoxy-modified (hereinafter may be referred to as "PO-modified")triacrylate, trimethylolpropane caprolactone-modified triacrylate, trimethylolpropane alkylene-modified trimethacrylate, pentaerythritol triacrylate, pentaerythritol tetraacrylate (PETTB), glyceroltriacrylate, glycerolepichlorohydrin-modified (hereinafter may be referred to as "ECH-modified)triacrylate, glycerol EO-modified triacrylate, glycerol PO-modified triacrylate, tris(acryloxyethyl)isocianulate, dipentaerythritol hexaacrylate (DPHB), dipentaerythritol caprolactone-modified hexaacrylate, dipentaerythritolhydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTB), pentaerythritol ethoxytetraacrylate, phosphate EO-modified triacrylate, and 2,2,5,5-tetrahydroxymethylcyclopentanone tetraacrylate. These may be used alone or in combination.

By adding the compound (Component B), three-dimensionally crosslinking bond density of a layer containing the cured material becomes higher. This may lead to obtain a photoconductor that has a further excellent abrasion resistance. The ratio of the molecular weight of Component B to the number of functional groups in the monomer (molecular weight/the number of functional groups) is preferably 250 or less to form a dense crosslinking bond inside a layer containing the cured material. When the ratio is greater than 250, the protective layer becomes soft and wear resistance reduces in some degree. Hence, it is not preferable using only a monomer having an extremely long modified group for the monomer having a modified group such as EO, PO and caprolactone in the exemplified monomers.

The proportion of the compound (Component B) cannot be flatly specified since electrical properties and abrasion resistance required for processes employed may differ depending on the process employed; however, it is preferably 20% by mass to 80% by mass and more preferably 30% by mass to 70% by mass relative to the total amount of the cured material. The content of Component B substantially depends on the proportion of the solid content of Component B in the coating solution. When Component B is less than 20% by mass, the effect of adding Component B is small. When it is greater than 80% by mass, the content of the charge transporting compound is reduced and thus a deterioration of electrical properties may occur. Considering the balance between two properties and the effect of addition, the content is most preferably in the range of 30% by mass to 70% by mass.

In an acrylic curable resin obtained by crosslinking reaction of at least Component A and Component B, additives such as monofunctional acrylic monomers, bifunctional acrylic monomers and leveling agents may further be added thereto. Besides, a polymerization initiator and a dissociated residual of the reaction may be contained in the acrylic curable resin in order to promote a crosslinking reaction. The crosslinking reaction by means of ultraviolet irradiation is effective to form a surface protective layer that has high hardness and excellent abrasion resistance. In this case, a photopolymerization initiator may be added for a crosslinking reaction.

The photopolymerization initiator is not particularly limited and may be appropriately selected depending on the intended purpose. Examples thereof include acetophenone photopolymerization initiators, ketal photopolymerization initiators, benzoinether photopolymerization initiators, benzophenone photopolymerization initiators, thioxanthone photopolymerization initiators, and other photopolymerization initiators. These may be used alone or in combination.

Examples of the acetophenone photopolymerization initiators and the ketal photopolymerization initiators include diethoxyacetophenone, 2,2-dimethoxy-1,2-diphenylethane-1-on, 1-hydroxy-cyclohexyl-phenyl-keton, 4-(2-hydroxyethoxy)phenyl-(2-hydroxy-2-propyl)ketone, 2-benzyl-2-dimethylamino-1-(4-morphorinophenyl)butanone-1,2-hydroxy-2-methyl-1-phenylpropane-1-on, 2-methyl-2-morphorino(4-methylthiophenyl)propane-1-on, and 1-phenyl-1,2-propanedion-2-(o-ethoxycarbonyl)oxime.

Examples of the benzoinether photopolymerization initiators include benzoin, benzoinmethylether, benzomethylether, benzoinisobutylether, and benzoinisopropylether.

Examples of the benzophenone photopolymerization initiators include benzophenone, 4-hydroxybenzophenone, o-benzoyl methyl benzoate, 2-benzoylnaphthalene, 4-benzoylbiphenyl, 4-benzoylphenylether, acrylated benzophenone, and 1,4-benzoylbenzene.

Examples of the thioxanthone photopolymerization initiators include 2-isopropylthioxanthone, 2-chlorothioxanthone, 2,4-dimethylthioxanthone, 2,4-diethylthioxanthone, and 2,4-dichlorothioxanthone.

Examples of the other photopolymerization initiators include ethylanthraquinone, 2,4,6-trimethylbenzoyldiphenylphosphinoxide, 2,4,6-trimethylbenzoylphenylethoxyphosphinoxide, bis(2,4,6-trimethylbenzoyl)phenylphosphinoxide, bis(2,4-dimethoxybenzoyl)-2,4,4-trimethylpentylphosphinoxide, methylphenylglyoxyester, 9,10-phenanthrene, acridine compounds, triadine compounds, and imidazole compounds.

Compounds having a photopolymerization promoting effect may be employed singly or together with the photopolymerization initiator described above. Examples of compounds having photopolymerization promoting effect include triethanolamine, methyldiethanolamine, 4-dimethylamino ethyl benzoate, 4-dimethylamino isoamyl benzoate, (2-dimethylamino)ethyl benzoate, and 4,4'-dimethylaminobenzophenone.

By adding the photopolymerization initiator, a chain polymerization reaction for forming the cured material promotes more uniformly in the entire film. This enables provision of a photoconductor having a small surface roughness.

The content of the photopolymerization initiator is preferably 0.5% by mass to 40% by mass and more preferably 1% by mass to 20% by mass relative to the total amount of the chain-polymerizable compound. When the content is less than 0.5% by mass, a film containing a cured material is non-uniformly formed and thus abrasion resistance may be reduced locally. When greater than 40% by mass, electrical properties may be degraded.

-Forming Method of Acrylic Resin-Curable Layer by Means of Light Irradiation-

The acrylic resin-curable layer is formed by producing a coating solution containing Component A, Component B, the amino group-containing acryl-modified polyorganosiloxane of the present invention, and the photopolymerization initiator, applying the coating solution on the surface of the photoconductor, exposing to light, and polymerizing the coating solution.

The coating solution is diluted with a solvent as necessary before application. Examples of the solvent include alcohols such as methanol, ethanol, propanol and butanol; ketones such as acetone, methylethylketon, methylisobutylketon and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolveacetate. These solvents may be employed alone or in combination. The dilution ratio of composition using solvent may differ according to the composition's solubility, coating method and desired thickness of the resultant layer, and thus is optional. The coating solution may be applied by means of dip coating, spray coating, bead coating, and ring coating. When producing the coating solution, in case where one of Component A and Component B is liquid, application of the coating solution dissolved other components therein may be possible.

In the coating solution, in addition to Component A, Component B, the amino group-containing acryl-modified polyorganosiloxane of the present invention and the photopolymerization initiator, a monofunctional chain polymerizable monomer, a bifunctional chain polymerizable monomer, a functional monomer and a chain polymerizable oligomer can be used in combination for the purpose of adjusting the viscosity of the coating solution, alleviating the stress of the protective layer, achieving low surface energy and reductions in friction coefficient.

These chain-polymerizable monomers and oligomers are not particularly limited and known monomers and oligomers may be employed.

Examples of the monofunctional radical monomer include 2-ethylhexylacrylate, 2-hydroxyethylacrylate, 2-hydroxypropylacrylate, tetrahydrofurfrylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, and styrene monomer.

Examples of the bifunctional chain-polymerizable monomer include 1,3-butanedioldiacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylatebisphenol B-EO-modified diacrylate, bisphenol F-EO-modified diacrylate, and neopentylglocoldiacrylate.

Examples of the functional monomer include fluorinated monomer such as octafluoropentylacrylate, 2-perfluorooctylethylacrylate, 2-perfluorooctylethylmethacrylate, 2-perfluoroisononylethylacrylate; monomer having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl, wherein the siloxane repeating unit is 20 to 70 as described in JP-B Nos. 05-60503 and 06-45770.

Examples of the chain-polymerizable oligomer include epoxyacrylate oligomer, urethaneacrylate oligomer, and polyesteracrylate oligomer.

If the considerable amount of the monofunctional and bifunctional chain polymerizable monomer and chain polymerizable oligomer is contained in the coating solution, three-dimensional crosslinking bond density of the cured composition is substantially reduced and degrades properties. Hence, the content of these monomers or oligomers is preferably 50% by mass or less and more preferably 30% by mass or less relative to the Component B.

Furthermore, various plasticizers (for alleviating stress and improving adhesiveness), leveling agents, and additives such as low molecular charge transporting materials not having radical reactivity may be added to the coating solution in accordance with necessity. Known additives can be used for these additives. Those used in typical resins such as dibutylphthalate and dioctylphthalate can be used for plasticizers and the content thereof is preferably 20% by mass or less and more preferably 10% by mass or less relative to the total solid content of the coating solution. As the leveling agents, silicone oils such as dimethylsilicone oil and methylphenylsilicone oil and polymers or oligomers having a perfluoroalkyl group in their side chain may be employed and the used amount is preferably 3% by mass or less relative to the total solid content of the coating solution.

After application of the coating solution, a drying process may be carried out and then the coating is cured by light irradiation in accordance with necessity. As the light irradiation, a UV irradiation light source such as a high pressure mercury vapor lamp or a metal halide lamp having a main emission wavelength in the ultraviolet range may be employed. A visible light source may also be used to comply with the absorption wavelength of the chain polymerizable compound and the photopolymerization initiator. The irradiation dose is preferably 50 $mW/cm^2$ or more and 2,000 $mW/cm^2$ or less. When the irradiation dose is less than 50 $mW/cm^2$, the curing reaction may take a longer time. When it is greater than 2,000 $mW/cm^2$, the reaction may proceed non-uniformly, resulting in local wrinkles as well as many unreacted residues or terminals on the surface of the surface protective layer. Also, an abrupt crosslinking increases inner stress, causing cracks or film exfoliation. In addition, nitrogen displacement may be performed during light irradiation to prevent oxygen from inhibiting polymerization. The light irradiation may be performed continuously or intermittently with a few intervals.

As an analogous means of light irradiation, electron beam irradiation may also be employed; however, it is preferably to use light energy by virtue of the ease of controlling the reaction speed and the simplicity of device. In a case of electron beam irradiation, a photopolymerization initiator may not be used. After the coating solution is cured by means of light irradiation, the cured material is annealed at 80° C. to 150° C. and then used as an electrophotographic photoconductor. The annealing time is about 1 minute to 60 minutes.

The thickness of the surface protective layer is not particularly limited and may be appropriately selected depending on the intended purpose. It is preferably 2 μm to 20 μm and more preferably 4 μm to 10 μm. When the thickness thereof is less than 2 μm, the added amount of an amino group-containing acryl-modified polyorganosiloxane is small and thus sustainability of properties may degrade. When it is greater than 20 μm, exfoliation of underlayer may tend to occur depending on the volume constriction at curing of the surface protective layer.

-Support-

The support is not particularly limited and may be appropriately selected depending on the intended purpose as long as it has such an electrical conductivity that volume resistance is $10^{10}$ Ω·cm or less. Examples thereof include film-shaped or cylindrically-shaped plastics or papers coated with a metal such as aluminum, nickel, chrome, nichrome, copper, gold, silver and platinum; and a metal oxide such as tin oxide and indium oxide by means of vapor deposition or sputtering; a plate of aluminum, aluminum alloy, nickel, stainless steel, or a tube which is subjected to surface process by cutting, superfinishing or polishing, etc. after the plate thereof is formed into the tube by methods such as extrusion or drawing. The endless nickel belt and endless stainless-steel belt disclosed in JP-A No. 52-36016 may also be employed as a support.

In addition, those obtained by dispersing conductive particles in an appropriate binder resin and then applying the binder resin on the support may also be employed as a support.

Examples of the conductive particle include carbon black, acetylene black; metal powder such as aluminum, nickel, iron, nichrome, copper, zinc and silver; and metal oxide fine particle such as conductive tin oxide and ITO. Examples of the binder resins used in combination include polystyrene resins, styrene-acrylonitrile copolymers, styrene-butadiene copolymers, styrene-maleic anhydride copolymers, polyester resins, polyvinylchloride resins, vinylchloride-vinyl acetate copolymers, polyvinyl acetate resins, polyvinylidenechloride resins, polyarylate resins, phenoxy resins, polycarbonate resins, acetylcellulose resins, ethylcellulose resins, polyvinylbutyral resins, polyvinylformal resins, polyvinyltoluene resins, poly-N-vinylcarbazole resins, acrylic resins, silicone resins, epoxy resins, melamine resins, urethane resins, phenol resins, and alkyd resins.

The conductive layer can be provided by dispersing these conductive particles and the binder resin into an appropriate solvent such as, for example, tetrahydrofuran, dichloromethane, methylethylketone, and toluene and then by applying these coating solution thereon.

Furthermore, supports which are prepared by forming a conductive layer on an appropriate cylindrical base with a thermal contractive tube made of an appropriate material such as polyvinyl chloride, polypropylene, polyester, polystyrene, polyvinylidene chloride, polyethylene, chlorinated rubber, Teflon™, etc. containing conductive particles may also be employed as the conductive layer.

-Intermediate Layer-

In the electrophotographic photoconductor of the present invention, an intermediate layer can be disposed between a charge transporting layer and a protective layer or between a photosensitive layer and a protective layer for the purpose of prevent infiltration of the charge transporting layer component into the protective layer or improving the adhesiveness therebetween.

As the intermediate layer, those which are insoluble or hardly soluble in a coating solution for a protective layer are favorable and typically, a binder resin is employed as a main component of the intermediate layer. Examples of the resins include polyamide resins, alcohol-soluble nylon resins, water-soluble polyvinylbutyral resins, polyvinylbutyral resins, and polyvinylalcohol resins. A method for forming the intermediate layer is not particularly limited and may be appropriately selected depending on the intended purpose. A typical coating method may be employed. The thickness of the intermediate layer is preferably 0.05 μm to 2 μm.

-Undercoat Layer-

In the electrophotographic photoconductor of the present invention, an undercoat layer may be formed between the support and the photosensitive layer. The main component of the undercoat layer is typically a resin, which is preferably the resin having high resistance against typical organic solvents in view of disposing the photosensitive layer by coating a solvent thereon. Examples of the resins include water-soluble resins such as polyvinyl alcohol, casein and sodium polyacrylate; alcohol-soluble resins such as copolymerized nylon and methoxymethylated nylon; curable resins forming a three dimensional network such as polyurethane resins, melamine resins, phenol resins, alkyd-melamine resins and epoxy resins. Besides, in the undercoat layer, a fine powder pigment of a metal oxide such as titanium oxide, silica, alumina, zirconium oxide, tin oxide and indium oxide may be added to avoid moiré and to reduce residual potential.

For the undercoat layer, those which are prepared with an anodic oxidation of $Al_2O_3$ or those which are prepared by means of vacuum thin film deposition of organic material such as polyparaxylylene (parylene) and inorganic materials such as $SiO_2$, $SnO_2$, $TiO_2$, ITO and $CeO_2$ may also be favorably employed. Known materials may also be employed.

The undercoat layer may be formed by using an appropriate solvent and a coating method in the same manner as that of the above-described photosensitive layer. Furthermore, for the undercoat layer of the present invention, silane coupling agents, titanium coupling agents and chromium coupling agents may also be employed.

The thickness of the undercoat layer is not particularly limited and may be appropriately selected depending on the intended purpose. It is preferably 0 μm to 5 μm.

An antioxidant may be added to each of the layers of the electrophotographic photoconductor of the present invention, e.g. the photosensitive layer, the surface protective layer, the charge transporting layer, the charge generating layer, the undercoat layer and the intermediate layer, for the purpose of improving environmental resistance and especially preventing the decrease in sensitivity and increase in residual potential.

Examples of the antioxidants include phenol compounds, paraphenylenediamines, hydroquinones, organic sulfur compounds and organic phosphorus compounds. These may be used alone or in combination.

Examples of the phenol compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid] glycol ester, and tocopherols.

Examples of the paraphenylenediamines include
N-phenyl-N'-isopropyl-p-phenylenediamine,
N,N'-di-sec-butyl-p-phenylenediamine,
N-phenyl-N-sec-butyl-p-phenylenediamine,
N,N'-di-isopropyl-p-phenylenediamine, and
N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorus compounds include triphenylphosphine, tri(nonylphenyl)phosphine, tri(di-nonylphenyl)phosphine, tricresylphosphine, and tri(2,4-dibutylphenoxy)phosphine.

These compounds are known as antioxidants for rubbers, plastics, and oils and fats, and commercialized products can be easily procured.

The added amount of the antioxidant is not particularly limited and may be appropriately selected depending on the intended purpose. It is preferably 0.01% by mass to 10% by mass relative to the total mass of the layer added therein.

(Image Forming Method and Image Forming Apparatus)

The image forming apparatus of the present invention includes at least an electrophotographic photoconductor, a latent electrostatic image forming unit, a developing unit, a transferring unit, a fixing unit, and a cleaning unit, and further includes additional units such as a charge eliminating unit, a recycling unit and a controlling unit, which are appropriately selected as necessary. The image forming method of the present invention includes at least a latent electrostatic image forming step, a developing step, a transferring step, a fixing step, and a cleaning step, and further includes additional steps such as a charge eliminating step, a recycling step, and a controlling step, which are appropriately selected as necessary.

The image forming method of the present invention can be preferably performed by means of the image forming apparatus of the present invention; the latent electrostatic image forming step can be performed by means of the latent electrostatic image forming unit; the developing step can be performed by means of the developing unit; the transferring step can be performed by means of the transferring unit; the fixing step can be performed by means of the fixing unit; the cleaning step can be performed by means of the cleaning unit; and the other steps can be performed by means of the other units.

-Latent Electrostatic Image Forming Step and Latent Electrostatic Image Forming Unit- The latent electrostatic image forming step is a step for forming a latent electrostatic image on an electrophotographic photoconductor.

For the electrophotographic photoconductor, the electrophotographic photoconductor of the present invention may be employed.

The latent electrostatic image can be formed, for example, by uniformly charging the surface of the electrophotographic photoconductor and then exposing the surface thereof imagewisely by means of the latent electrostatic image forming unit.

The latent electrostatic image forming unit includes, for example, at least a charging unit configured to uniformly charge the surface of the electrophotographic photoconductor, and an exposing unit configured to imagewisely expose the surface of the electrophotographic photoconductor.

The surface of the electrophotographic photoconductor can be charged by applying a voltage thereto through the use of, for example, the charging unit.

The charging unit is not particularly limited and may be appropriately selected depending on the intended purpose. Examples of known charging units include contact charging units equipped with a conductive or semi-conductive roller, brush, film or rubber blade, and non-contact charging units utilizing corona discharge, such as corotrons and scorotrons.

The surface of the electrophotographic photoconductor can be exposed imagewisely through the use of, for example, the exposing unit.

The exposing unit is not particularly limited and may be appropriately selected depending on the intended purpose as long as it can expose imagewisely the surface of the electrophotographic photoconductor that has been charged by the charging unit. Examples thereof include various exposing units such as reproducing optical systems, rod lens array systems, laser optical systems, and liquid crystal shutter optical systems.

In the present invention, a backlight system may be employed that performs imagewise exposure from the back side of the electrophotographic photoconductor.

When an image forming apparatus is used as a copier or a printer, the photoconductor surface is imagewisely exposed by irradiation with reflected light or transmitted light from an original document. Alternately, imagewise exposure is performed by reading out an original document by a sensor to convert information into digital signals, scanning the photoconductor with a laser beam in accordance with the signals, and exposing the photoconductor by driving an LED array or a liquid crystal shutter array.

-Developing Step and Developing Unit-

The developing step is a step for developing the latent electrostatic image using a toner and/or developer to form a visible image.

The visible image can be formed by developing the latent electrostatic image using a toner and/or developer by means of, for example, the developing unit.

The developing unit is not particularly limited and may be appropriately selected from those known in the art as long as it can develop a latent electrostatic image using a toner and/or developer. Preferred examples thereof include those having at least a developing device which houses a toner and/or developer therein and can supply the toner and/or developer to the latent electrostatic image in a contact or a non-contact manner.

As the toner, using a spherical toner with a small particle diameter is preferable in order to output high resolution and highly fine images. That is, the average circularity of the toner is preferably 0.92 to 1, the volume average particle diameter (Dv) thereof is preferably 4 μm to 8 μm, and the ratio (Dv/Dn) between volume average particle diameter (Dv) thereof and the number average particle diameter (Dn) thereof is preferably 1.00 to 1.40. By a combination of such a toner and an electrophotographic photoconductor, it is possible to provide an image forming apparatus that can output highly fine images, is a compact apparatus having no lubricant application mechanism, and can reuse the toner.

Typically, the smaller the particle diameter of the toner is, the more advantageous for obtaining high quality, high-resolution images. Smaller toner particles, however, are disadvantageous in terms of transferring properties and cleanability. When the volume average particle diameter of toner is smaller than the value of the above-described range and the toner is used as a two component developer, the toner is fused on the surface of the carrier in a long term agitation in the developing device to degrade the charging ability of the carrier, whereas when the toner is used as a one component developer, filming of the toner to the developing roller and fusing of the toner to members such as a blade for thinning the toner easily occur. In contrast, when the particle diameter of the toner is larger than the above-mentioned range, it may be difficult to obtain high quality images with high resolution, and the particle diameter of the toner often varies when the toner in the developer inflows or outflows. The same applies when the ratio (Dv/Dn) is larger than 1.4. When the ratio (Dv/Dn) is close to 1.0, it is preferable in terms of uniformization and stabilization of behavior of toner, and uniformization of charged amount.

When the average circularity of the toner is less than 0.92, it results in failure to obtain high-quality images with less dusts and to achieve satisfactory transferring ability because toner particles have irregular shapes that are far from spherical shape. To determine the toner shape, a method is used in which a suspension liquid containing toner particles is passed through a plate-like detecting zone of an imaging unit, toner particle images are detected by a CCD camera and analyzed. Average circularity, a value obtained by dividing the circumferential length of a circle having the same area as the projected area obtained in that manner by the circumferential length of an actually existing particle is appropriate for the evaluation value. A toner having an average circularity close to 1 allows provision of high quality images with less dusts and excellent transferring ability. However, cleaning defects generally occur on a photoconductor surface and it is necessary to apply a lubricant over the photoconductor surface. However, a combination of such a toner and the electrophotographic photoconductor of the present invention allows cleaning of the photoconductor surface in a low temperature and low humidity environment without lubricant application. Thus, it is possible to provide a compact image forming apparatus having no lubricant application mechanism, which the apparatus can maintain high transferring ability and provide high quality images using the toner having the above noted diameter and shape, and which can achieve reuse of toner.

Although there is no distinct property-change point in the range circularity, this range is still an effective range to ensure high quality images and high blade cleanability without lubricant application.

The toner is not particularly limited and may be appropriately selected depending on the intended purpose; however, a toner with fine resin particles or toner base having a glass transition temperature (Tg) of 50° C. to 90° C., produced by ester elongation polymerization, may be employed.

In the ester elongation polymerization method, the toner is obtained by dissolving and/or dispersing in an organic solvent an active hydrogen group-containing compound and a toner material which contains a modified polyester resin reactive with the active hydrogen group-containing compound, a colorant, and a releasing agent to prepare a toner solution; emulsifying and/or dispersing the toner solution in an aqueous medium to prepare a dispersion liquid; reacting the active hydrogen group-containing compound and the modified polyester resin in the dispersion liquid to remove the organic solvent.

An example of the modified polyester resins includes polyester prepolymer having an isocyanate group, in which a carboxyl group or a hydroxyl group of a polyester terminal is reacted with a polyisocyanate compound (PIC). A modified polyester resin which is obtained by crosslinking and/or elongating molecular chain with a reaction of the polyester prepolymer and amines can improve hot offset properties while maintaining low temperature fixing ability.

Examples of the polyisocyanate compounds (PIC) include aliphatic polyisocyanates such as tetramethylene diisocyanate, hexamethylene diisocyanate and 2,6-diisocyanatomethyl caproate; alicyclic polyisocyanates such as isophorone diisocyanate and cyclohexylmethane diisocyanate; aromatic diisocyanates such as trilene diisocyanate and diphenylmethane diisocyanate; aromatic-aliphatic diisocyanates such as α,α,α',α'-tetramethylxylylene diisocyanate; isocyanates; and those in which the polyisocyanate is blocked by phenol derivatives, oximes, caprolactams. These may be used alone or in combination.

The mixing ratio of the polyisocyanate compound (PIC) is defined as an equivalent ratio [NCO]/[OH] of an isocyanate group [NCO] in the polyisocyanate compound (PIC) to a hydroxyl group [OH] in the polyester having a hydroxyl group. It is preferably 5/1 to 1/1, more preferably 4/1 to 1.2/1, and further more preferably 2.5/1 to 1.5/1.

The average number of an isocyanate group contained in a molecule of a polyester prepolymer (A) having the isocyanate group is preferably 1 or more, more preferably 1.5 to 3, and further more preferably 1.8 to 2.5.

Examples of amines (B) reacted with the polyester prepolymer include bivalent amine compounds (B1), trivalent or more polyvalent amine compounds (B2), amino alcohols (B3), amino mercaptans (B4), amino acids (B5), and those (B6) in which the amino group(s) of B1 to B5 is blocked.

Examples of the bivalent amine compounds (B1) include aromatic diamines such as phenylenediamine, diethyltoluenediamine and 4,4'-diaminodiphenylmethane; alicyclic diamines such as 4,4'-diamino-3,3'-dimethyldicyclohexylmethane, diamine cyclohexane and isophoronediamine; aliphatic diamines such as ethylenediamine, tetramethylenediamine and hexamethylenediamine.

Examples of the trivalent or more polyvalent amine compounds (B2) include diethylenetriamine and triethylenetetramine.

Examples of the amino alcohols (B3) include ethanol amine and hydroxyethyl aniline.

Examples of the amino mercaptans (B4) include aminoethyl mercaptan and aminopropyl mercaptan.

Examples of the amino acids (B5) include aminopropionic acid and aminocaproic acid.

Examples of those (B6) in which the amino group(s) of B1 to B5 are blocked include ketimine compounds obtained from any one of the amines (B1) to (B5) and ketones such as acetone, methyl ethyl ketone and methyl isobutyl ketone; and oxazolidine compounds. Among these amines (B), B1 and a mixture of B1 with a small amount of B2 are particularly preferable.

The mixing ratio of the amine is defined as an equivalent ratio [NCO]/[NHx] of an isocyanate group [NCO] in a polyesterprepolymer (A) having an isocyanate group to an amino group [NHx] in amines (B). It is preferably 1/2 to 2/1, more preferably 1.5/1 to 1/1.5, and further more preferably 1.2/1 to 1/1.2.

According to a production method of toner by means of the above noted ester elongation polymerization method, it can produce a spherical toner with a small particle diameter with small environmental impact at low cost. Using a combination of a polymerized toner produced by means of ester elongation method with the electrophotographic photoconductor, it is possible to provide a compact, electrical-power saving image forming apparatus having no lubricant application mechanism, which can output highly fine images, can reuse toner, has low fixing temperature, and consumes less electricity used in heating for fixation.

The electrical-power saving image forming apparatus can be provided by combining a toner with a low glass transition temperature obtained by means of ester elongation polymerization method, i.e. a toner that is hardly removed by blade cleaning, with the electrophotographic photoconductor of the present invention.

The developing device normally employs a dry development system. The developing device may be a monochrome or multi-color developing device. Preferred examples thereof include those having a stirrer whereby the toner and/or developer is charged by friction-stirring and rotatable magnet rollers.

In the developing device, for example, a toner and carrier may be mixed and stirred together. The toner is thus charged by frictional force at that time to be held in a state where the toner is standing on the surface of a rotating magnet roller to thereby form a magnetic brush. Since the magnet roller is arranged in the proximity of the electrophotographic photoconductor, a part of the toner composing the magnetic brush formed on the surface of the magnet roller is moved toward the surface of the electrophotographic photoconductor due to the force of electrical attraction. As a result, a latent electrostatic image is developed by the use of toner, and a visible toner image is formed on the surface of the electrophotographic photoconductor.

The developer contained in the developing device is a developer containing a toner, and the developer may be a one-component developer or a two-component developer. Commercially available products can be employed as the toner.

-Transferring Step and Transferring Unit-

The transferring step is a step for transferring the visible image onto a recording medium. In a preferred embodiment, primary transferring is performed using an intermediate transferring member by which the visible image is transferred onto the intermediate transferring member, and secondary transferring is performed wherein the visible image is transferred onto the recording medium. In a more preferred embodiment, primary transferring is performed by transferring the visible image onto the intermediate transferring member using the toner of two or more colors and preferably of full-color to form a complex transferred image, and secondary transferring is performed by transferring the complex transferred image onto the recording medium.

The transferring of the visible image can be performed, for example, by charging the electrophotographic photoconductor using a transferring charger, which can be performed by the transferring unit. In a preferred embodiment, the transferring unit contains a primary transferring unit which transfers the visible image onto the intermediate transferring member to form a complex transferred image and a secondary transferring unit which transfers the complex transferred image onto the recording medium. The intermediate transferring member is not particularly limited and may be appropriately selected from known transferring members depending on the intended purpose. Preferred examples thereof include transferring belts.

The transferring units of the primary and secondary transferring preferably contain an image-transfer unit which releases by charging the visible image formed on the electrophotographic photoconductor to the recording medium side. There may be one or two or more of the transferring units.

Examples of the image-transfer unit include a corona transfer unit based on corona discharge, transfer belt, transfer roller, pressure transfer roller, and adhesion transfer unit.

The recording medium is typically standard paper but is not particularly limited and may be appropriately selected depending on the intended purpose as long as it can transfer an unfixed image after developing. PET based films for OHP may also be employed.

-Fixing Step and Fixing Unit-

The fixing step is a step for fixing the visible image which has been transferred onto the recording medium using a fixing unit. The fixing step may be performed for a developer of each color transferred onto the recording medium, or in one operation when the developers of each color have been laminated thereon.

The fixing unit is not particularly limited and may be appropriately selected depending on the intended purpose but known heat pressurizing units are favorable. Examples of the heat pressurizing units include a combination of a heat roller and a pressure roller, and a combination of a heat roller, a pressure roller and an endless belt.

The heating temperature in the heat pressurizing unit is preferably 80° C. to 200° C.

In the present invention, for example, an optical fixing unit known in the art may be used in addition to or in place of the fixing step and fixing unit depending on the application.

-Cleaning Step and Cleaning Unit-

The cleaning step is a step for removing the residual toner on the electrophotographic photoconductor using the cleaning unit.

Examples of the cleaning units include cleaning blades, magnetic brush cleaners, electrostatic brush cleaners, magnetic roller cleaners, blade cleaners, brush cleaners, and web cleaners.

Any cleaning method can be employed for toner cleaning because adhesion of toner is reduced by using a combination of the electrophotographic photoconductor with the spherical toner with a small particle diameter; however, a method for contacting a cleaning blade directly with the photoconductor is most preferable when considering the fact that the cleaning device has been miniaturized, simplified, durable, and adapted for high speed printing. By a combination of the cleaning blade method, the electrophotographic photoconductor, and the spherical toner with a small particle diameter, it is possible to provide a compact, electrical-power saving image forming apparatus having no lubricant application mechanism, which can output highly fine images, can reuse the toner, has low fixing temperature, and consumes less electricity used in heating for fixation. As the cleaning unit, a cleaning blade and other cleaning units may be employed in combination.

The contact pressure and contact angle of a cleaning blade, and materials and forms of a cleaning blade can be appropriately employed from known conditions, materials, and forms. Although the cleanability generally improves as higher contact pressure is applied, abrasion of photoconductors and blades tends to become large. Therefore, the specification of the cleaning blade is appropriately adjusted according to the specification of the image forming apparatus.

As a more preferred cleaning blade, a known elastic rubber blade may be employed. It is preferably that the rebound resilience of the elastic rubber blade be 5% to 15% in the range of 15° C. to 30° C., the rebound resilience thereof be 10% to 20% in the range of 30° C. to 45° C., and it is preferable to use the elastic rubber blade having a JIS A hardness (Hs) of 77 to 85 degrees.

The cleaning step can be performed by using two of these cleaning blades.

The charge eliminating step is a step for eliminating a charge by applying a charge eliminating bias to the electrophotographic photoconductor and may be suitably performed by means of a charge eliminating unit.

The charge eliminating unit is not particularly limited as long as it is capable of applying a charge eliminating bias to the electrophotographic photoconductor and may be appropriately selected from charge eliminating units known in the art, i.e. discharge lamps.

The recycling step is a step for recycling the toner removed by means of the cleaning step to the developing unit, and may be suitably performed by means of a recycling unit.

The recycling unit is not particularly limited and examples thereof include transport units known in the art.

The controlling step is a step for controlling the respective steps, and may be suitably performed by means of a control unit.

The control unit is not particularly limited and may be appropriately selected depending on the intended purpose as long as it can control movement of the respective units, and examples thereof include apparatuses such as sequencers or computers.

The first embodiment of the image forming apparatus of the present invention will be described with reference to FIG. 5.

Figure 5:
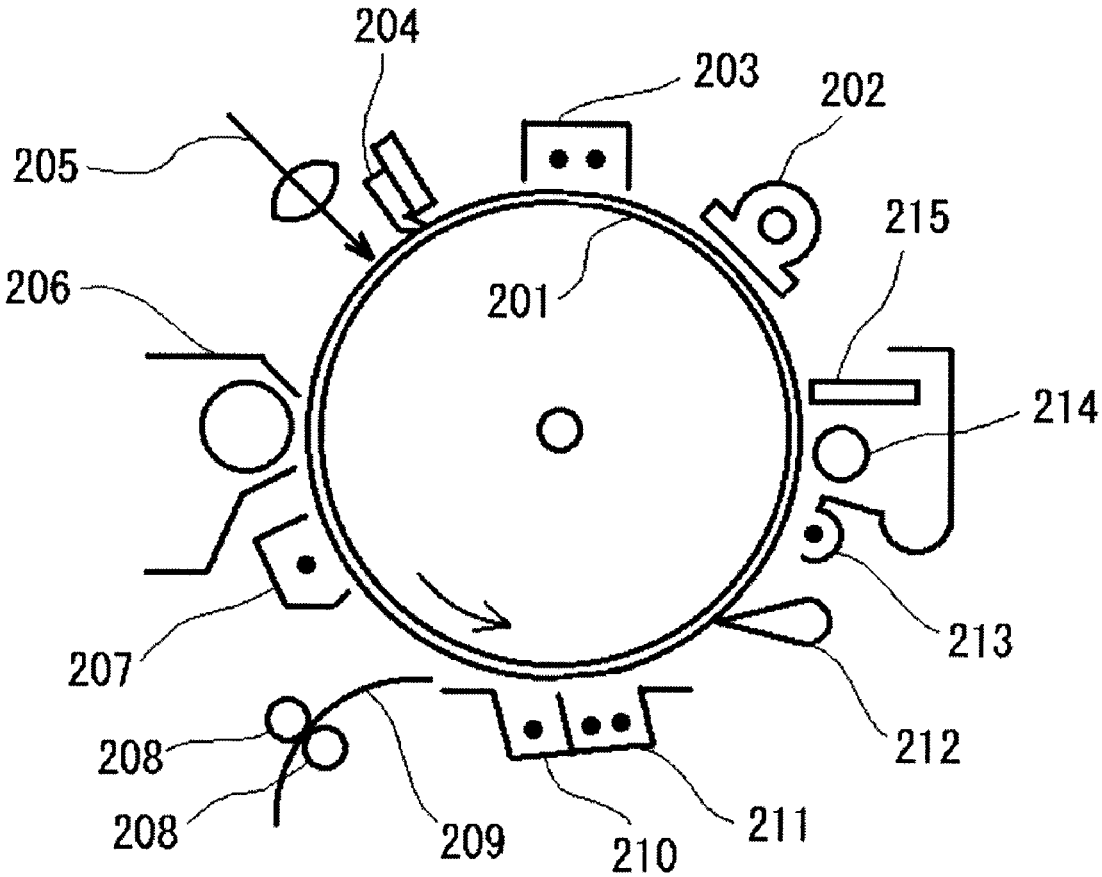
FIG. 5 is a schematic view showing an example of the image forming apparatus of the present invention.

FIG. 5 is a schematic view showing an example of the image forming apparatus of the present invention and modified examples shown below are also within the scope of the present invention.

For an electrophotographic photoconductor 201, the electrophotographic photoconductor of the present invention may be employed. The photoconductor 201 is of drum-shaped in the drawing, but it may be of either sheet-shaped or endless belt-shaped. In FIG. 5, 204 is an eraser and 208 is a resist roller.

For a charging unit configured to evenly charge the photoconductor 201, an electric charger 203 may be employed. Examples of the electric charger include a corotron device, scorotron device, solid discharging element, multi-stylus electrode device, roller charge device, conductive brush device; and known devices in the art can be employed.

The configuration of the present invention is particularly effective when a charging unit decomposes a photoconductor composition by means of a close discharge from the charging unit such as a contact charging system or a non-contact closely-spaced charging system. Here, the contact charging system is a charging system that a photoconductor directly contacts with a charged roller, charged brush, charged blade. The closely-spaced charging system is a charging system that a charge roller, for example, is closely allocated between a surface of a photoconductor and a charging unit with a gap of 200 μm or less in a non-contact state. When the gap is too large, the charge may become unstable, whereas when the gap is too small, the surface of the charging member may be contaminated if a residual toner exists on the photoconductor. Hence, the gap is preferably 10 μm to 200 μm, and more preferably 10 μm to 100 μm.

An image exposing unit 205 is employed to form a latent electrostatic image on the uniformly charged photoconductor 201. A light source thereof may be light-emitting materials in general such as fluorescent lighting, tungsten lamp, halogen lamp, mercury lamp, sodium lamp, light-emitting diode (LED), laser diode (LD) and electroluminescence (EL). Various filters such as a sharp-cut filter, band-pass filter, near-infrared-cut filter, dichroic filter, interference filter and color conversion filter may also be employed to irradiate only light having a desired wavelength.

Next, a developing unit 206 is employed to visualize the latent electrostatic image formed on the photoconductor 201. For the developing system, there are a one-component developing method with a dry toner, a two-component developing method, and a wet developing method with a wet toner. When image exposure is performed with a positively (negatively) charged photoconductor, a positive (negative) latent electrostatic image is formed on the surface of the photoconductor. A positive image may be obtained by developing the positive (negative) latent electrostatic image with a negative (positive) toner, i.e. detection particles, and a negative image may be obtained by developing the same with a positive (negative) toner.

Next, a transfer charger 210 is employed to transfer a toner image visualized on the photoconductor 201 onto a recording medium 209. A pre-transfer charger 207 may be employed for more favorable transfer. For a method using a transfer unit thereof, an electrostatic transfer method using a transfer charger or a bias roller, a mechanical transfer method such as adhesive transfer method and pressure transfer method, and a magnetic transfer method can be employed. For the electrostatic transfer method, the charging unit may be employed.

Next, as a separating mean, a separating charger 211 and a separating claw 212 are employed to separate the recording medium 209 from the photoconductor 201. Other separating means include inductive separation by electrostatic absorption, side edge belt separation, tip gripping transfer, and self stripping. For the separation charger 211, the charging unit may be employed.

A fur brush 214 and a cleaning blade 215 may be employed to clean the toner remained on the photoconductor 201 after transferring. A pre-cleaning charger 213 may also be employed for more efficient cleaning. Other cleaning means include a web method and a magnetic brush method, and these may be used alone or in combination. A charge eliminating means may be employed in order to remove the latent image on the photoconductor in accordance with necessity. For the charge eliminating means, a charge eliminating lamp 202 and a neutralizing charger may be employed, for which the exposing light source and the charge eliminating means can be employed, respectively. Known processes may be employed for such processes as document scanning that is conducted away from the photoconductor, paper feeding, fixing, and paper delivery.

An embodiment to implement the image forming method of the present invention by means of the image forming apparatus of the present invention will be described with reference to FIG. 6. An image forming apparatus 100 shown in FIG. 6 is equipped with a photoconductor drum 10 as the electrophotographic photoconductor (hereinafter may be referred to as "photoconductor 10"), a charge roller 20 as the charging unit, an exposing device 30 as the exposing unit, a developing device 40 as the developing unit, an intermediate transfer member 50, a cleaning device 60 with a cleaning blade as the cleaning means, and a charge eliminating lamp 70 as the charge eliminating unit.

An intermediate transfer member 50 is an endless belt and is designed such that it loops around three rollers 51 deposited its inside and rotates in the direction shown by the arrow by means of the rollers 51. One or more of three rollers 51 also function as a transfer bias roller capable of applying a certain transfer bias (primary bias) to the intermediate transfer member 50. A cleaning device 90 having a cleaning blade is placed adjacent to the intermediate transfer member 50. A transfer roller 80 is placed facing to the intermediate transfer member 50 as the transfer unit capable of applying the transfer bias so as to transfer a developed image (toner image) onto a transfer sheet 95 as the final transfer material (secondary transfer). In the surrounding area of the intermediate transfer member 50, a corona charger 58, for charging toner image on the intermediate transfer member 50, is placed between contact area of the photoconductor 10 and the intermediate transfer member 50 and contact area of the intermediate transfer member 50 and the transfer paper 95 in the rotating direction of the intermediate transfer member 50.

A developing device 40 includes a developing belt 41 as the developer bearing member, a black developing unit 45K, a yellow developing unit 45Y, a magenta developing unit 45M, and a cyan developing unit 45C, four developing units being positioned parallel around the developing belt 41. The black developing unit 45K is equipped with a developer container 42K, a developer feeding roller 43K and a developing roller 44K. The yellow developing unit 45Y is equipped with a developer container 42Y, a developer feeding roller 43Y and a developing roller 44Y. The magenta developing unit 45M is equipped with a developer container 42M, a developer feeding roller 43M and a developing roller 44M. The cyan developing unit 45C is equipped with a developer container 42C, a developer feeding roller 43C and a developing roller 44C. The developing belt 41 is an endless belt looped around a plurality of belt rollers so as to be rotatable. A part of the developing belt 41 is in contact with the photoconductor 10.

Figure 6:
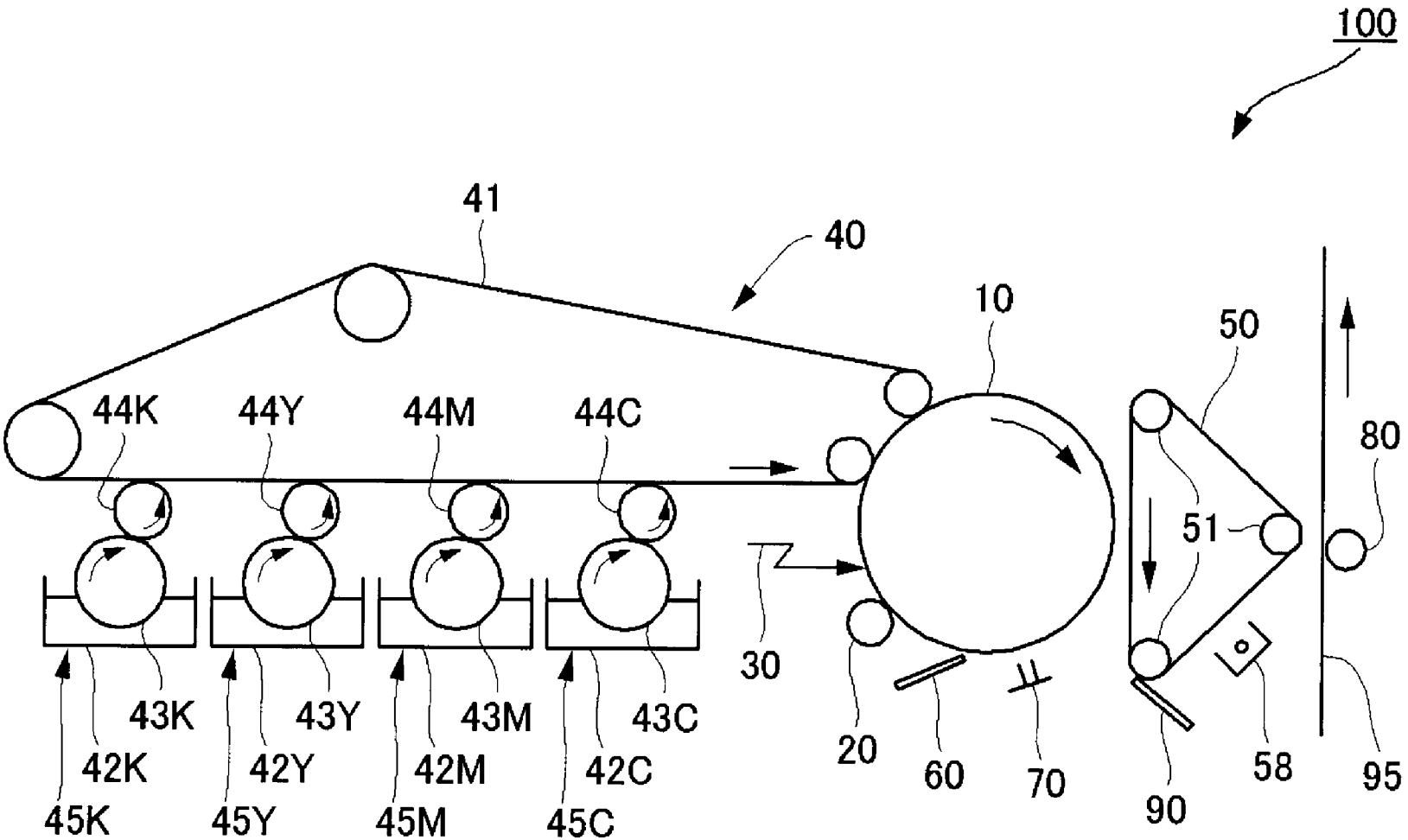
FIG. 6 is a schematic explanatory view showing another example of the image forming apparatus of the present invention.

In an image forming apparatus 100 shown in FIG. 6, the photoconductor drum 10 is uniformly charged by means of, for example, a charging roller 20. An exposure device 30 then exposes imagewisely on the photoconductor drum 10 so as to form a latent electrostatic image. The latent electrostatic image formed on the photoconductor drum 10 is provided with toners from the developing device 40 to form a visible image (toner image). The visible image (toner image) is then transferred onto the intermediate transferring member 50 by the voltage applied from the roller 51 (primary transfer) and it is further transferred onto the transfer sheet 95 (secondary transfer). As a result, a transferred image is formed on the transfer sheet 95. The residual toner on the photoconductor 10 is removed by the cleaning unit 60 and the charge built up over the photoconductor 10 is temporarily removed by the discharge lamp 70. In FIG. 6, 42M is the developer container and 43Y is the developer feeding roller.

Figure 7:
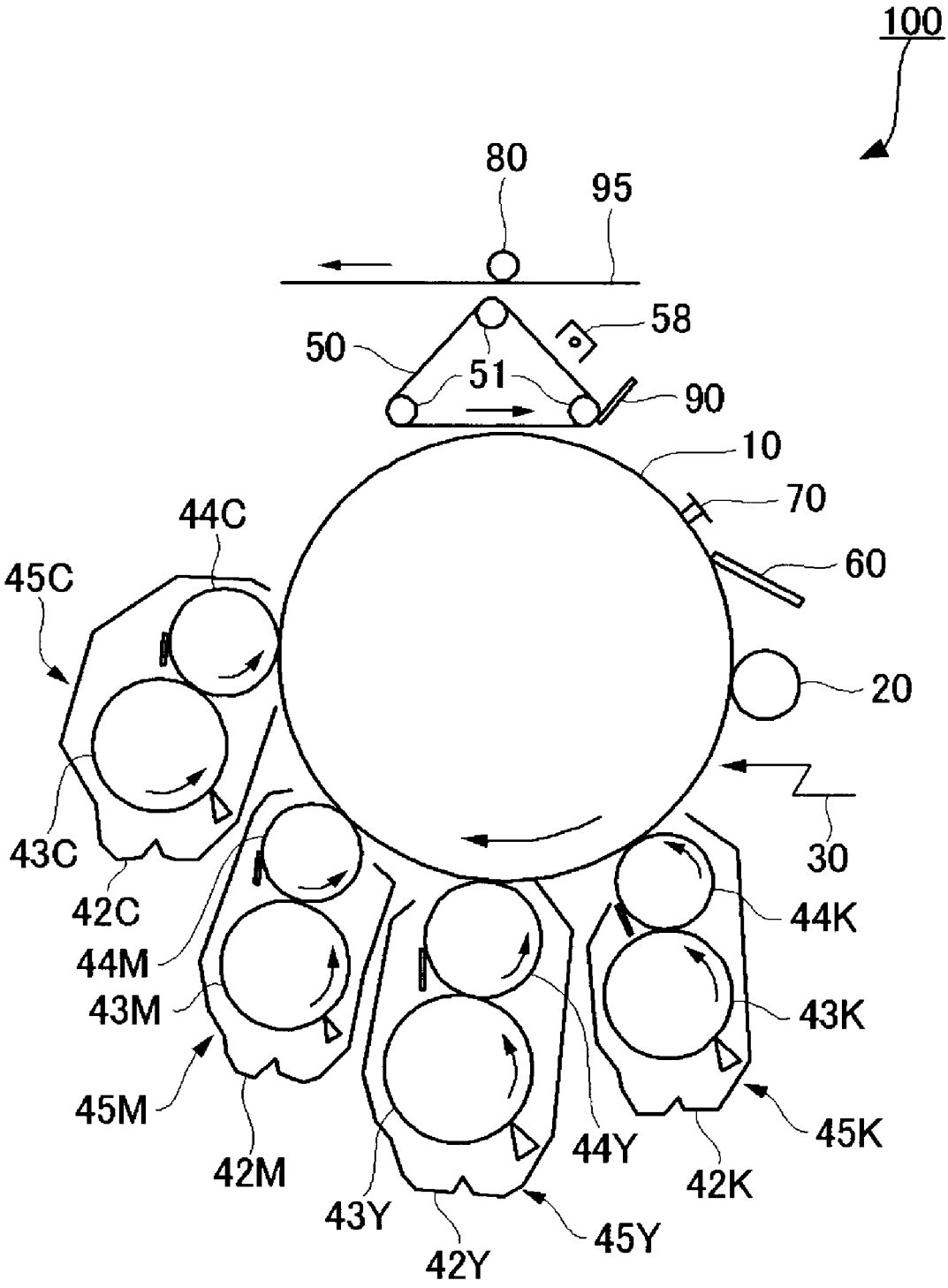
FIG. 7 is a schematic explanatory view showing still another example of the image forming apparatus of the present invention.

The other embodiment to implement the image forming method of the present invention by means of the image forming apparatus of the present invention will be described with reference to FIG. 7. The image forming apparatus 100 shown in FIG. 7 has an identical configuration and working effects to those of the image forming apparatus 100 shown in FIG. 6 except that this image forming apparatus 100 is not equipped with the developing belt 41 and that the black developing unit 45K, the yellow developing unit 45Y, the magenta developing unit 45M, and the cyan developing unit 45C are placed so as to face the photoconductor 10. In FIG. 7, units that are identical to those in FIG. 6 are denoted by the same reference numerals.

Figure 8:
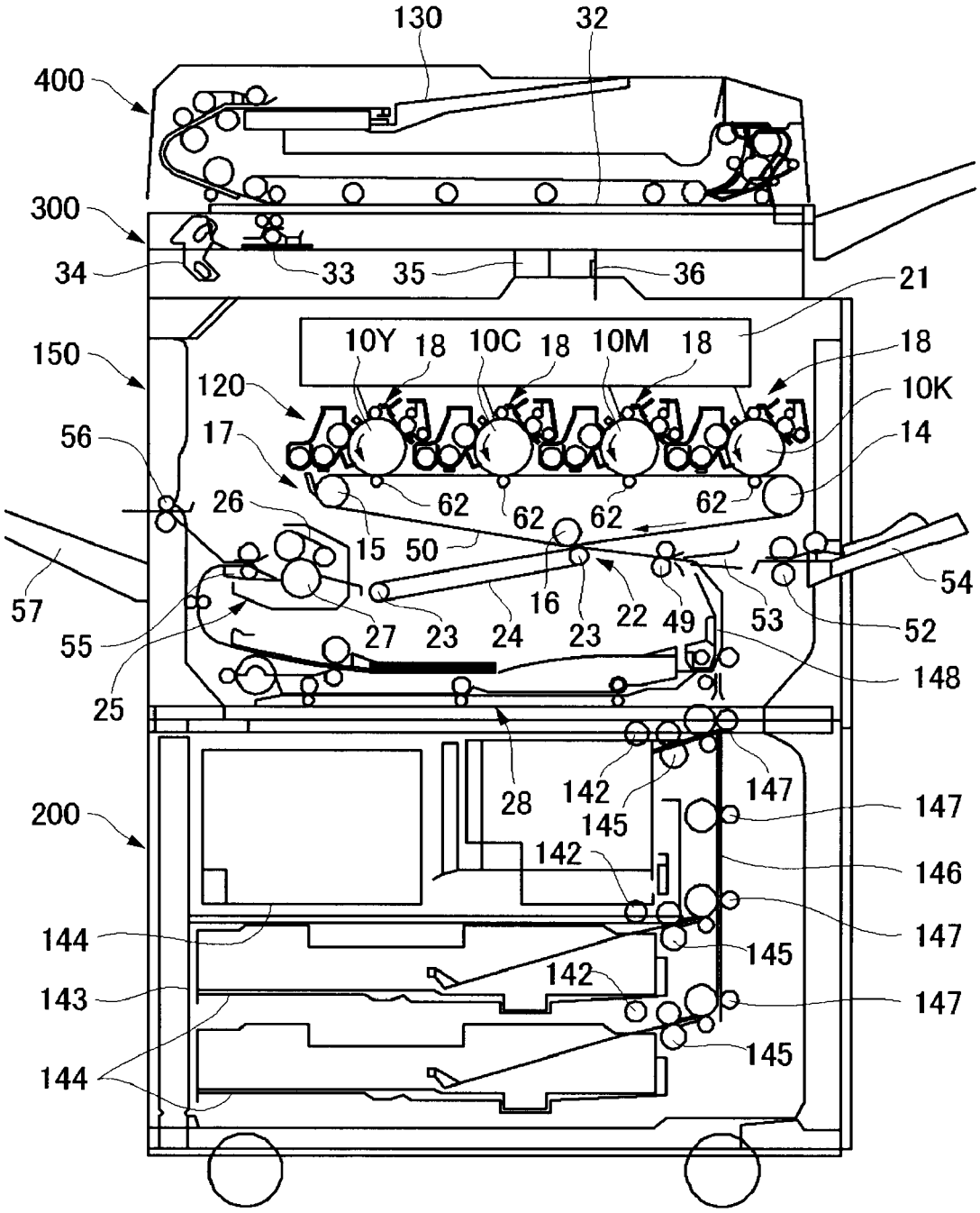
FIG. 8 is a schematic explanatory diagram showing an example of the image forming apparatus (tandem type color image forming apparatus) of the present invention.

Another embodiment to implement the image forming method of the present invention by means of the image forming apparatus of the present invention will be described with reference to FIG. 8. A tandem image forming apparatus shown in FIG. 8 is a tandem color image forming apparatus. The tandem image forming apparatus is equipped with a copying apparatus body 150, a paper feed table 200, a scanner 300, and an automatic document feeder (ADF) 400.

In the copying apparatus body 150, an endless belt-shaped intermediate transferring member 50 is located at the center. The intermediate transferring member 50 is spanned over support rollers 14, 15, and 16 and rotatable clockwise in FIG. 8. Near the support roller 15, an intermediate transferring member cleaning apparatus 17 is placed to remove the residual toner on the intermediate transferring member 50. On the intermediate transferring member 50 spanned by the support roller 14 and the support roller 15, a tandem developing unit 120 is placed, opposite to which four image forming units 18 of yellow, cyan, magenta, and black are arranged in parallel along the transporting direction. Near the tandem developing unit 120, an exposing apparatus 21 is placed. On the side of the intermediate transferring member 50 opposite to the side of the tandem developing unit 120, a secondary transferring device 22 is placed. In the secondary transferring device 22, a secondary transferring belt 24 as an endless belt is spanned over a pair of rollers 23, and transfer paper transported on the secondary transferring belt 24 and the intermediate transferring member 50 can contact with each other. Near the secondary transferring device 22, a fixing device 25 is placed. The fixing device 25 is equipped with a fixing belt 26 as an endless belt and a pressure roller 27 arranged such that it is being pressed thereby.

Near the secondary transferring device 22 and the fixing unit 25 of the tandem image forming apparatus, a sheet inverting device 28 is placed to invert the transferred paper so that images are formed on both sides of the transfer paper.

Next, the formation of a full-color image, i.e. color copy by means of the tandem image forming apparatus will be described. That is, first of all, an original document is placed on a document table 130 of the automatic document feeder (ADF) 400, or the original document is placed on a contact glass 32 of a scanner 300 by opening the automatic document feeder 400, which is then closed.

A start switch (not shown) is pressed, and the scanner 300 is activated to drive a first carriage 33 and a second carriage 34 after the document is fed and transported onto the contact glass 32 when the original document has been placed on the automatic document feeder 400, or immediately at the time when the original copy is placed on the contact glass 32. At this time, a beam of light emitted from the light source is carried by the first carriage 33, and the light reflected from the document surface is reflected by a mirror in the second carriage 34, which is received by a reading sensor 36 through an imaging lens 35. As a result, a color document (color image) is read as black, yellow, magenta, and cyan image information.

Figure 9:
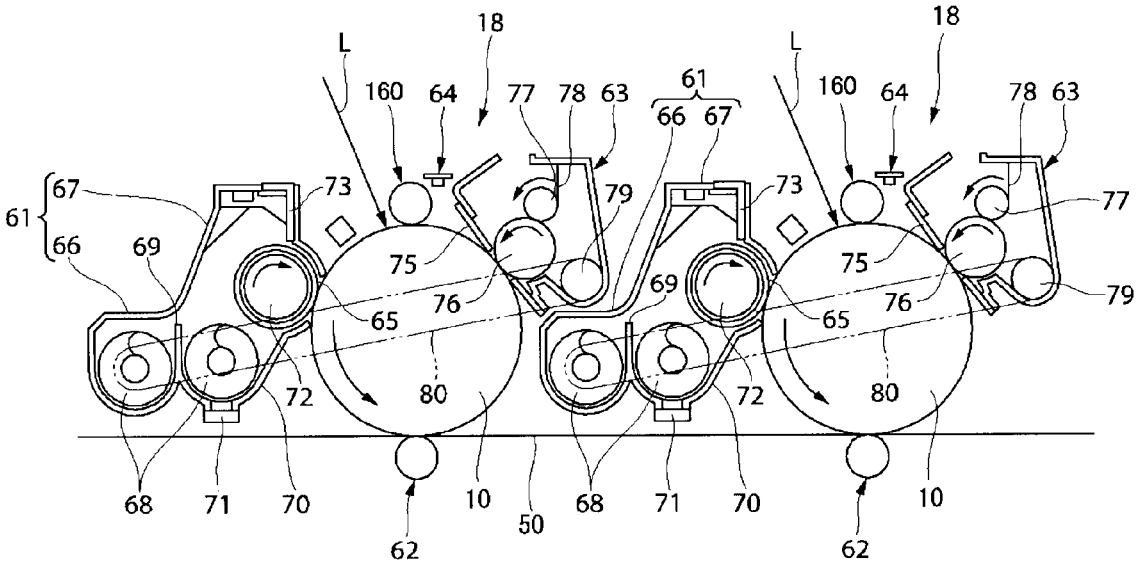
FIG. 9 is a partially expanded schematic explanatory view of the image forming apparatus shown in FIG. 8.

Each of the black, yellow, magenta, and cyan image information is transmitted to each image forming units 18 (black image forming unit, yellow image forming unit, magenta image forming unit, and cyan image forming unit) in the tandem image forming apparatus, and black, yellow, magenta, and cyan toner images are formed in the respective image forming units. That is, as shown in FIG. 9, each image forming units 18 (black image forming unit, yellow image forming unit, magenta image forming unit, and cyan image forming unit) in the tandem image forming apparatus is equipped with a photoconductor 10 (black photoconductor 10K, yellow photoconductor 10Y, magenta photoconductor 10M, and cyan photoconductor 10C); a charging unit 60 that uniformly charges the photoconductor; an exposing unit that exposes the photoconductor imagewisely (FIG. 9, L) corresponding to the respective color image based on the color image information and forms a latent electrostatic image of the respective color image on the photoconductor; a developing unit 61 that develops the latent electrostatic image using the respective color toner (black toner, yellow toner, magenta toner, and cyan toner) and forms a toner image of the respective color toner; a transfer charging unit 62 for transferring the toner image on the intermediate transferring member 50; a photoconductor cleaning device 63; and a charge eliminating unit 64. Therefore, based on the image information of the respective color, an image of a single color (black image, yellow image, magenta image, and cyan image) can be formed. The black image formed on the black photoconductor 10K, the yellow image formed on the yellow photoconductor 10Y, the magenta image formed on the yellow photoconductor 10M, and the cyan image formed on the cyan photoconductor 10C are sequentially transferred on the intermediate transferring member 50, which is rotationally shifted by means of the support rollers 14, 15, and 16 (primary transfer). Then, a composite color image (color transfer image) is formed by superimposing the black image, the yellow image, the magenta image, and the cyan image on the intermediate transferring member 50. In FIG. 9, 71 is a cleaning blade and 72 is a support member.

On the other hand, on a paper feed table 200, one of feed rollers 142 is selectively rotated to feed a sheet of recording paper from one of multi-stage paper feeding cassettes 144 provided in a paper bank 143. The sheet is separated one by one and delivered to a paper feeding path 146 by separation rollers 145. It is then transported and guided by conveyance rollers 147 to a paper feeding path 148 in a copying machine body 150 and finally stopped by striking to a resist roller 49. Alternatively, one of feed rollers 142 is rotated to let out a sheet of recording paper on a manual paper tray 54. The sheets are separated one by one and delivered to a paper feeding path 53 by separation rollers 52 and then stopped by being bumped to the resist roller 49. Here, the resist roller 49 is generally used grounded but may be employed in a state that a bias is applied for paper-powder removal. Then, the resist roller 49 is rotated with precise timing with the composite color image (color transfer image) combined on the intermediate transferring member 50 to feed the sheet (recording paper) between the intermediate transferring member 50 and the secondary transferring device 22, and by transferring the composite color image (color transfer image) on the sheet (recording paper) by means of the secondary transferring device 22 (secondary transfer), and a color image is thus transported and formed on the sheet (recording paper). The residual toner on the intermediate transferring member 50 after the image transfer is cleaned by means of the intermediate transferring member cleaning unit 17.

The sheet (recording paper) on which the color image is transferred and formed is transported and delivered by the secondary transfer unit 22 to the fixing device 25, and in the fixing device 25, the composite color image (color transfer image) is fixed on the sheet (recording paper) under heat and pressure. Then, the sheet (recording paper) is switched by a switching claw 55, discharged by a delivery roller 56, and stacked on a copy receiving tray 57. Alternatively, the sheet (recording paper) is switched by the switching claw 55, reversed by means of the sheet reversing device 28 and guided again to the transferring position for recording an image on the back side. It is then discharged by the delivery roller 56 and stacked on the copy receiving tray 57. In FIG. 9, 160 is a charging device.

(Process Cartridge)

The process cartridge of the present invention contains at least the electrophotographic photoconductor of the present invention and the developing unit configured to develop the latent electrostatic image on the electrophotographic photoconductor using the toner to form the visible image, and further contains other units such as charging unit, developing unit, transferring unit, cleaning unit and charge eliminating unit as necessary.

The developing unit contains at least a developer container for storing the toner and/or developer of the present invention and a developer carrier for carrying and feeding the toner and/or developer stored in the developer container and may further contain a layer thickness control member for controlling the thickness of carried toner layer.

The process cartridge of the present invention can be detachably attached to various image forming apparatuses and is preferably detachably attached to the image forming apparatus of the present invention as the above-mentioned.

Figure 10:
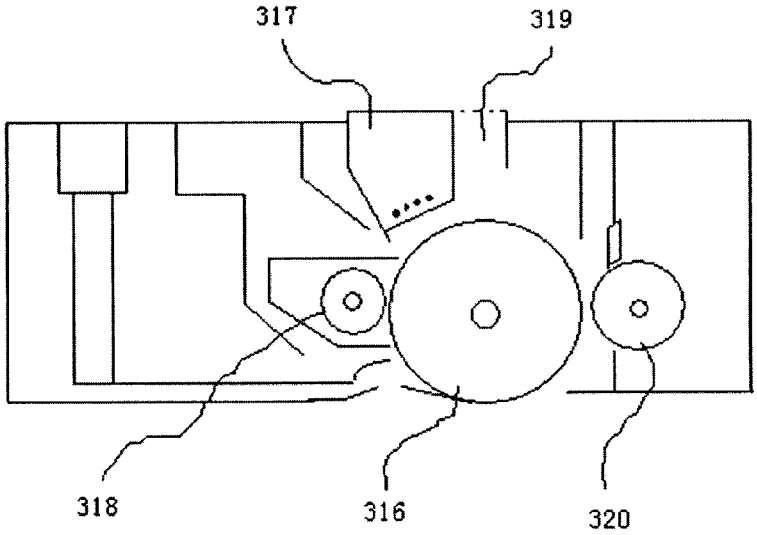
FIG. 10 is a schematic view showing an example of the process cartridge of the present invention.

The process cartridge, for example, as shown in FIG. 10, houses a photoconductor 316. It also contains a charging unit 317, an exposing unit 319, a developing unit 320, a cleaning unit 318, a transferring unit (not shown), a charge eliminating unit (not shown), and further contains other units in accordance with necessity.

An image forming process by means of the process cartridge shown in FIG. 10 will be described. A latent electrostatic image corresponding to an exposure image is formed on a surface of the photoconductor 316, which is rotating in the direction of the arrow, by charging with the charging unit 317 and then exposing with the exposing unit 319. The latent electrostatic image is toner developed in the developing unit 320, and the toner development is transferred onto the recording medium by means of the transferring unit (not shown) and printed out. Next, the surface of the photoconductor after the image transfer is cleaned by means of the cleaning unit 318 and further discharged by means of the charge eliminating unit (not shown) and these operations are again repeated.

For the image forming apparatus of the present invention, a component such as the electrophotographic photoconductor, a developing unit and a cleaning unit is integrated to form a process cartridge, and this unit may be detachably attached to the apparatus body. Also, at least one selected from the charging unit, the image exposing unit, the developing unit, the transferring and separating unit, and the cleaning unit is supported with the electrophotographic photoconductor to form the process cartridge as a single unit which can be detachably attached to the apparatus body, and the unit may have a detachable configuration using a guiding unit such as rail on the apparatus body.

The image forming method, the image forming apparatus, and the process cartridge of the present invention can be used not only in electrophotographic copiers but also in other electrophotographic application fields such as laser printers, CRT printers, LED printers, liquid crystal printers and laser plate making.

EXAMPLES

Hereinafter, with reference to Examples and Comparative Examples, the present invention will be described, which however shall not be construed as limiting the scope of the present invention.

Synthesis Example 1

<Synthesis of Amino Group-Containing Acryl-modified Polyorganosiloxane (P-1)>

-Synthesis of Polyorganosiloxane-

One thousand five hundred parts by mass of octamethylcyclotetrasiloxane, 8.8 parts by mass of vinyldimethoxymethylsilane, 16.6 parts by mass of 3-aminopropylmethyldiethoxysilane, and 1,500 parts by mass of ion exchange water were mixed together. To the mixture, 15 parts by mass of sodium lauryl sulfate and 10 parts by mass of dodecylbenzenesulfonic acid were added. The resultant mixture was then subjected to agitation by means of a homomixer for emulsification and a stable emulsion was prepared after two passes through a homogenizer operated at 3,000 bar.

The obtained emulsion was poured into a flask and heated for 12 hours at 70° C. Then the emulsion was cooled to 25° C. and then left for 24 hours. Thereafter, the pH of the emulsion was adjusted to 7 by the addition of sodium carbonate, and the emulsion was then subjected to steam distillation after blowing in nitrogen gas for 4 hours to remove volatile siloxane. Finally, ion exchange water was added to the emulsion for adjusting non-volatile content to 45% by mass and thereby polysiloxane emulsion was synthesized.

-Synthesis of Copolymerized Emulsion-

To a 2 L, three-neck flask equipped with an agitation device, a condenser, a thermometer and a nitrogen gas inlet, 778 parts by mass of emulsion of polysiloxane obtained above (350 parts by mass of siloxane) and 322 parts by mass of ion exchange water were poured and the mixture was then adjusted to 30° C. in a nitrogen gas stream. Thereafter, 1.0 part by mass of t-butylhydroperoxide, 0.5 parts by mass of L-ascorbic acid, and 0.002 parts by mass of ferrous sulfate heptahydrate were added in the flask.

While maintaining the temperature of the mixture at 30° C., 112.4 parts by mass of methylmethacrylate, 7.5 parts by mass of tris(2-acryloyloxyethyl)isocyanulate, and 30 parts by mass of acryloyloxyethylhexahydrophthalimide were added dropwise in the flask over 5 hours. After completion of the addition, the resultant mixture was stirred continuously for 3 hours to complete the reaction. The solid content of the obtained copolymerized emulsion was 39.6% by mass.

Then, 1,000 parts by mass of the obtained emulsion was poured into a flask equipped with an agitation device and heated to 80° C. A solution in which 70 parts by mass of sodium sulfate had been dissolved in 280 parts by mass of ion exchange water was added to the flask and an amino group-containing acryl-modified polyorganosiloxane was deposited, then subjected to filtration, washing, repeating of methanol washing, drying at 80° C., and thereby the amino group-containing acryl-modified polyorganosiloxane (P-1) was obtained.

Synthesis Examples 2 to 11

-Synthesis of Amino Group-Containing Acryl-Modified Polyorganosiloxanes (P-2 to P-11)-

Amino group-containing acryl-modified polyorganosiloxanes (P-2 to P-11) were synthesized in the same manner as that in Synthesis Example 1 except that the compositions of polyorganosiloxanes and monomers for graft copolymerization were changed to those shown in the following Table 1.

TABLE 1

| Component (Part by mass) | | Synthesis Example 1 P-1 | 2 P-2 | 3 P-3 | 4 P-4 | 5 P-5 | 6 P-6 |
|---|---|---|---|---|---|---|---|
| Polyorganosiloxane Composition (A) | octamethylcyclotetrasiloxane | 1500 | 1500 | 1500 | 1500 | 1500 | 1500 |
| | vinyldimethoxymethylsilane | 8.8 | 8.8 | 8.8 | 8.8 | 8.8 | 8.8 |
| | 3-aminopropylmethyldiethoxysilane | 8.8 | 16.6 | 33.2 | 16.6 | 16.6 | 16.6 |
| | 3-aminopropyldimethoxyethylsilane | — | — | — | — | — | — |
| Monomer (B) for graft-copolymerization | methylmethacrylate | 112.4 | 112.4 | 112.4 | 145.5 | 138 | 115.5 |
| | tris(2-acryloyloxyethyl)isocyanulate | 7.5 | 7.5 | 7.5 | — | — | — |
| | acryloyloxyethylhexahydrophtalimide | 30 | 30 | 30 | — | — | — |
| | 2-hydroxyethylmethacrylate | — | — | — | 4.5 | 4.5 | 4.5 |
| | acrylonitrile | — | — | — | — | 7.5 | 30 |
| | Mass Ratio (C:D)* | 75/25 | 75/25 | 75/25 | 97/3 | 92/8 | 77/23 |
| Mass Ratio (A:B) | | 70/30 | 70/30 | 70/30 | 70/30 | 70/30 | 70/30 |

| Component (Part by mass) | | Synthesis Example 7 P-7 | 8 P-8 | 9 P-9 | 10 P-10 | 11 P-11 |
|---|---|---|---|---|---|---|
| Polyorganosiloxane Composition (A) | octamethylcyclotetrasiloxane | 1500 | 1500 | 1500 | 1500 | 1500 |
| | vinyldimethoxymethylsilane | 8.8 | 10.0 | 10.0 | 10.0 | 8.8 |
| | 3-aminopropylmethyldiethoxysilane | 16.6 | — | — | — | 16.6 |
| | 3-aminopropyldimethoxyethylsilane | — | 8.8 | 16.6 | 33.2 | — |
| Monomer (B) for graft-copolymerization | methylmethacrylate | 127.5 | 237.5 | 225 | 207 | 150 |
| | tris(2-acryloyloxyethyl)isocyanulate | 7.5 | — | 12.5 | 7.5 | — |
| | acryloyloxyethylhexahydrophtalimide | 7.5 | — | 12.5 | 30 | — |
| | 2-hydroxyethylmethacrylate | — | 12.5 | — | — | — |
| | acrylonitrile | 7.5 | — | — | 5.5 | — |
| | Mass Ratio (C:D)* | 85/15 | 95/5 | 90/10 | 82.8/17.2 | 100/0 |
| Mass Ratio (A:B) | | 70/30 | 58/42 | 58/42 | 58/42 | 70/30 |

*Mass Ratio (C:D): Mass ratio of methylmethacrylate (C) to monomers (D) copolymerizable with the same

Example 1

-Production of Electrophotographic Photoconductor-

A coating solution for an undercoat layer of the following composition was applied by dip coating on an aluminum (Al) support with an outer diameter of 30 mm to form an undercoat layer with a thickness of 3.5 μm when measured after drying.

| Coating Solution for Undercoat Layer | |
|---|---|
| Alkyd resin (Beckosol 1307-60-EL manufactured by Dainippon Ink and Chemicals, Inc.) | 6 parts by mass |

-continued

| Coating Solution for Undercoat Layer | |
|---|---|
| Melamine resin (Super Beckamine G-821-60 manufactured by Dainippon Ink and Chemicals, Inc.) | 4 parts by mass |
| Titanium oxide (CR-EL manufactured by ISHIHARA SANGYO KAISYA, LTD.) | 40 parts by mass |
| Methyl ethyl ketone (MEK) | 50 parts by mass |

A coating solution for a charge generating layer of the following composition was applied by dip coating on an undercoat layer and the coated undercoat layer was heated and dried to form a charge generating layer with a thickness of 0.2 μm when measured after drying.

| Coating Solution for Charge Generating Layer | |
|---|---|
| Bisazo pigment represented by the following structural formula | 2.5 parts by mass |

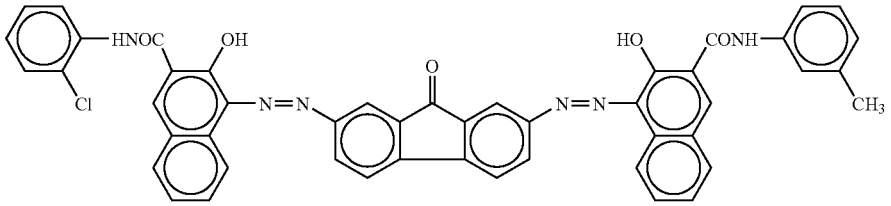

| | |
|---|---|
| Polyvinylbutyral (XYHL manufactured by UCC Inc.) | 0.5 parts by mass |
| Cyclohexanone | 200 parts by mass |
| Methyl ethyl ketone | 80 parts by mass |

A coating solution for a charge transporting layer of the following composition was applied by dip coating on a charge generating layer and the coated charge generating layer was heated and dried to form a charge transporting layer with a thickness of 25 μm when measured after drying.

| Coating Solution for Charge Transporting layer | |
|---|---|
| Bisphenol type Z polycarbonate | 10 parts by mass |
| Low molecular charge transporting material represented by the following structural formula | 10 parts by mass |

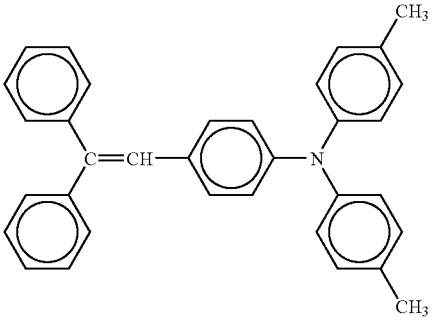

| | |
|---|---|
| Tetrahydrofuran | 79 parts by mass |
| Amino group-containing acryl-modified polyorganosiloxane (P-1 prepared in Synthesis Example 1) | 1 part by mass |
| Tetrahydrofuran solution of 1% by mass silicone oil (KF50-100CS manufactured by Shin-Etsu Chemical Co., Ltd.) | 0.2 parts by mass |

As the above-mentioned, an electrophotographic photoconductor in which the amino group-containing acryl-modified polyorganosiloxane is dispersed inside an outermost layer of a charge transporting layer was produced. In the charge transporting layer, the amino group-containing acryl-modified polyorganosiloxane was dispersed in a particle state and the average particle diameter thereof was 200 nm as determined by measurement of their sections with a transparent electron microscope (TEM).

Example 2

-Production of Electrophotographic Photoconductor-

An electrophotographic photoconductor of Example 2 was produced in the same manner as that of Example 1 except that the amino group-containing acryl-modified polyorganosiloxane (P-1 prepared in Synthesis Example 1) in the coating solution for charge transporting layer was replaced by the amino group-containing acryl-modified polyorganosiloxane (P-10 prepared in Synthesis Example 10).

Example 3

-Production of Electrophotographic Photoconductor-

In the same manner as that in Example 1, an undercoat layer and a charge generating layer were prepared by applying a coating solution on an aluminum (Al) support with an outer diameter of 30 mm.

A coating solution for a charge transporting layer of the following composition was applied by dip coating on a charge generating layer and the coated charge generating layer was heated and dried to form a charge transporting layer with a thickness of 22 μm when measured after drying.

| Coating Solution for Charge Transporting layer | |
|---|---|
| Bisphenol type Z polycarbonate | 10 parts by mass |
| Low molecular charge transporting material represented by the following structural formula | 10 parts by mass |

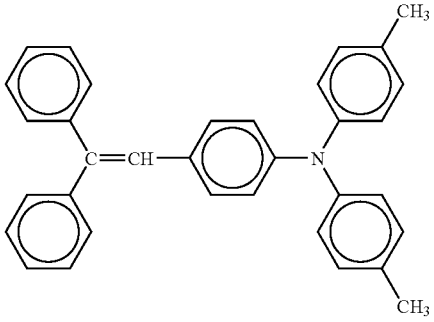

| | |
|---|---|
| Tetrahydrofuran | 80 parts by mass |
| Tetrahydrofuran solution of 1% by mass silicone oil (KF50-100CS manufactured by Shin-Etsu Chemical Co., Ltd.) | 0.2 parts by mass |

A coating solution for a surface protective layer of the following composition was applied by spray coating on the obtained charge transporting layer and the coated charge transporting layer was exposed to a laser beam having an intensity of 500 mW/cm$^2$ for 200 seconds by using a metal halide lamp, and then dried at 130° C. for 30 minutes to form an acrylic curable surface protective layer with a thickness of 3.0 μm.

| Coating Solution for Surface Protective Layer | |
|---|---|
| Trimethylolpropanetriacrylate (KAYARAD TMPTA manufactured by Nippon Kayaku Co., Ltd., molecular weight = 382, the number of functional groups = 3, molecular weight/the number of functional groups = 99) | 10 parts by mass |
| 4-{2-[4-(di-para-trylamino)phenyl]-1-phenylvinyl}phenylacrylate | 9 parts by mass |
| Phenylbis(2,4,6-trimethylbenzoyl)phosphynoxide as a photopolymerization initiator (IRGACURE 819 manufactured by Ciba Specialty Chemicals K.K.) | 2 parts by mass |
| Amino group-containing acryl-modified polyorganosiloxane (P-1 prepared in Synthesis Example 1) | 1 part by mass |
| Tetrahydrofuran | 100 parts by mass |

As the above-mentioned, an electrophotographic photoconductor of Example 3 was produced. In the acrylic curable surface protective layer, the amino group-containing acryl-modified polyorganosiloxane was dispersed in a particle state. The average particle diameter thereof was 70 nm as determined by measurement of their sections with a transparent electron microscope (TEM).

Example 4

-Production of Electrophotographic Photoconductor-

An electrophotographic photoconductor of Example 4 was produced in the same manner as that of Example 3 except that the coating solution for a surface protective layer of the following composition was employed.

| Coating Solution for Surface Protective Layer | |
|---|---|
| Trimethylolpropanetriacrylate (KAYARAD TMPTA manufactured by Nippon Kayaku Co., Ltd., molecular weight = 382, the number of functional groups = 3, molecular weight/the number of functional groups = 99) | 10 parts by mass |
| 4'-(di-para-trylamino)biphenyl-4-ylacrylate | 10 parts by mass |
| 1-hydroxy-cyclohexyl-phenyl-ketone as a photopolymerization initiator (IRGACURE 184 manufactured by Ciba Specialty Chemicals K.K.) | 2 parts by mass |
| Amino group-containing acryl-modified polyorganosiloxane (P-1 prepared in Synthesis Example 1) | 1 part by mass |
| Tetrahydrofuran | 100 parts by mass |

As the above-mentioned, an electrophotographic photoconductor of Example 4 was produced. In the acrylic curable surface protective layer, the amino group-containing acryl-modified polyorganosiloxane was dispersed in a particle state and the average particle diameter thereof was 150 nm as determined by measurement of their sections with a transparent electron microscope (TEM).

Examples 5 to 13

-Production of Electrophotographic Photoconductor-

Each of the electrophotographic photoconductors of Examples 5 to 13 was produced in the same manner as that of Example 4 except that the amino group-containing acryl-modified polyorganosiloxane (P-1 prepared in Synthesis Example 1) in the coating solution for a surface protective layer was replaced by the amino group-containing acryl-modified polyorganosiloxanes of P-2 to P-10 obtained by Synthesis Examples 2 to 10 respectively as shown in the following Table 2.

In the acrylic curable surface protective layer, the amino group-containing acryl-modified polyorganosiloxane was dispersed in a particle state. The average particle diameter thereof was determined by measurement of their sections with a transparent electron microscope (TEM). The results are shown in Table 2.

TABLE 2

| | An amino group-containing acryl-modified polyorganosiloxane | Average Particle Diameter (nm) |
|---|---|---|
| Example 4 | P-1 | 70 |
| Example 5 | P-2 | 100 |
| Example 6 | P-3 | 110 |
| Example 7 | P-4 | 100 |
| Example 8 | P-5 | 110 |
| Example 9 | P-6 | 150 |
| Example 10 | P-7 | 130 |
| Example 11 | P-8 | 100 |
| Example 12 | P-9 | 80 |
| Example 13 | P-10 | 90 |

Comparative Example 1

-Production of Electrophotographic Photoconductor-

An electrophotographic photoconductor of Comparative Example 1 was produced in the same manner as that of Example 1 except that the amino group-containing acryl-modified polyorganosiloxane (P-1 prepared in Synthesis Example 1) was not added to the coating solution for a charge transporting layer.

Comparative Example 2

-Production of Electrophotographic Photoconductor-

An electrophotographic photoconductor of Comparative Example 2 was produced in the same manner as that of Example 2 except that the amino group-containing acryl-modified polyorganosiloxane (P-10 prepared in Synthesis Example 10) was not added to the coating solution for a charge transporting layer.

Comparative Example 3

-Production of Electrophotographic Photoconductor-

An electrophotographic photoconductor of Comparative Example 3 was produced in the same manner as that of Example 3 except that the amino group-containing acryl-modified polyorganosiloxane (P-1 prepared in Synthesis Example 1) was not added to the coating solution for a surface protective layer.

Comparative Example 4

-Production of Electrophotographic Photoconductor-

An electrophotographic photoconductor of Comparative Example 4 was produced in the same manner as that of Example 4 except that the amino group-containing acryl-modified polyorganosiloxane (P-1 prepared in Synthesis Example 1) was not added to the coating solution for a surface protective layer.

Comparative Example 5

-Production of Electrophotographic Photoconductor-

An electrophotographic photoconductor of Comparative Example 5 was produced in the same manner as that of Example 1 except that the amino group-containing acryl-modified polyorganosiloxane (P-1 prepared in Synthesis Example 1) in the coating solution for a charge transporting layer was replaced by an acryl-modified polyorganosiloxane containing no amino group. The acryl-modified polyorganosiloxane containing no amino group was synthesized in the same manner as polyorganosiloxane of Synthesis Example 1 except that 8.8 parts by mass of 3-aminopropylmethyldiethoxysilane was not added.

Comparative Example 6

-Production of Electrophotographic Photoconductor-

An electrophotographic photoconductor of Comparative Example 6 was produced in the same manner as that of Example 2 except that the amino group-containing acryl-modified polyorganosiloxane (P-10 prepared in Synthesis Example 10) in the coating solution for a charge transporting layer was replaced by an acryl-modified polyorganosiloxane containing no amino group. The acryl-modified polyorganosiloxane containing no amino group was synthesized in the same manner as that for polyorganosiloxane of Synthesis Example 10 except that 33.2 parts by mass of 3-aminopropyldimethoxysilane was not added.

Comparative Example 7

-Production of Electrophotographic Photoconductor-

An electrophotographic photoconductor of Comparative Example 7 was produced in the same manner as that of Example 3 except that the amino group-containing acryl-modified polyorganosiloxane (P-1 prepared in Synthesis Example 1) in the coating solution for a surface protective layer was replaced by an acryl-modified polyorganosiloxane not containing an amino group. The acryl-modified polyorganosiloxane not containing an amino group was synthesized in the same manner as that for polyorganosiloxane of Synthesis Example 1 except that 8.8 parts by mass of 3-aminopropylmethyldiethoxysilane was not added.

Comparative Example 8

-Production of Electrophotographic Photoconductor-

An electrophotographic photoconductor of Comparative Example 8 was produced in the same manner as that of Example 4 except that the amino group-containing acryl-modified polyorganosiloxane (P-1 prepared in Synthesis Example 1) in the coating solution for a surface protective layer was replaced by an acryl-modified polyorganosiloxane not containing an amino group. The acryl-modified polyorganosiloxane not containing an amino group was synthesized in the same manner as polyorganosiloxane of Synthesis Example 1 except that 8.8 parts by mass of 3-aminopropylmethyldiethoxysilane was not added.

<Evaluation>

For each of the obtained electrophotographic photoconductors, the following toner was loaded to the developing device and the toner was uniformly deposited onto the surface of the electrophotographic photoconductor by means of the developing device such that the initial concentration becomes 0.2. Thereafter, the photoconductor was rotated at a speed of 79.5 rotations per minute while pressing thereto a polyurethane rubber blade formed by means of polyurethane crosslinking at a contact angle of 78 degrees and a contact pressure of 0.25 N/cm. After one minute rotation of the photoconductor, a residual toner thereon was transferred to a blank paper sheet with Scotch Tape (manufactured by Sumitomo 3M Co., Ltd.), and the concentration of the residual toner was measured with Macbeth reflection densitometer RD type 514. The concentration was measured in a normal temperature and normal humidity environment (25° C., 50 RH %) and in a low temperature and low humidity environment (10° C., 15 RH %). The results are shown in Table 3.

-Toner-

A toner which was prepared by means of a method (ester elongation polymerization method) described in Example 1 of JP-A No. 2003-202701 was employed. The toner had a volume average particle diameter (Dv) of 6.03 μm, a number average particle diameter (Dn) of 5.52 μm, a ratio of Dv to Dn of 1.09, and an average circularity of 0.951.

TABLE 3

| | 25° C., 50 RH % Concentration | 10° C., 15 RH % Concentration |
|---|---|---|
| Example 1 | 0.012 | 0.02 |
| Example 2 | 0.01 | 0.022 |
| Example 3 | 0.008 | 0.012 |
| Example 4 | 0.005 | 0.011 |
| Example 5 | 0.007 | 0.013 |
| Example 6 | 0.008 | 0.011 |
| Example 7 | 0.008 | 0.018 |
| Example 8 | 0.009 | 0.012 |
| Example 9 | 0.008 | 0.011 |
| Example 10 | 0.011 | 0.02 |
| Example 11 | 0.012 | 0.018 |
| Example 12 | 0.011 | 0.019 |
| Example 13 | 0.01 | 0.02 |
| Comparative Example 1 | 0.2 | 0.2 |
| Comparative Example 2 | 0.2 | 0.2 |
| Comparative Example 3 | 0.2 | 0.2 |
| Comparative Example 4 | 0.2 | 0.2 |
| Comparative Example 5 | 0.011 | 0.2 |
| Comparative Example 6 | 0.012 | 0.2 |
| Comparative Example 7 | 0.01 | 0.2 |
| Comparative Example 8 | 0.01 | 0.2 |

From the results shown in table 3, it was confirmed that the photoconductors of Examples 1 to 13 exhibited favorable cleanability in a normal temperature and normal humidity environment and in a low temperature and low humidity environment.

By contrast, typical organic photoconductors (OPC) containing an acryl-modified polyorganosiloxane containing no amino group in their main chain as in Comparative Examples 5 to 8, exhibited favorable cleanability in a normal temperature and normal humidity environment, but it resulted in failure to clean those photoconductors in a low temperature and low humidity environment. Besides, it was confirmed that photoconductors containing no acryl-modified polyorganosiloxane as in Comparative Examples 1 to 4, offered poor cleanability even in a normal temperature and normal humidity environment.

Example 14

<Production of Single-Layered Photoconductor>

A coating solution for a photosensitive layer of the following composition was applied by dip coating on an aluminum (Al) support with an outer diameter of 30 mm to form a photosensitive layer with a thickness of 25 μm when measured after drying.

| Coating Solution for Photosensitive layer | |
|---|---|
| Metal-free phthalocyanine (Fastogen Blue 8120B manufactured by DAINIPPON INK AND CHEMICALS, INCORPORATED) | 2 parts by mass |
| Low molecular charge transporting material represented by the following structural formula | 24 parts by mass |

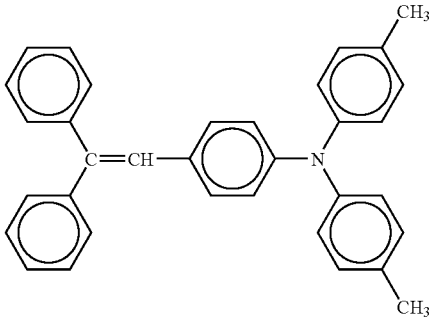

| | |
|---|---|
| Diphenoquinone compound (2,6-dimethyl-2',6'-di-tert-butyl-diphenoquinone) | 20 parts by mass |
| Amino group-containing acryl-modified polyorganosiloxane (Synthesis Example 11, P-11) | 8.7 part by mass |
| Bisphenol type Z polycarbonate | 41 parts by mass |
| Tetrahydrofuran | 306 parts by mass |
| Cyclohexanone | 76 parts by mass |
| Tetrahydrofuran solution of 1% by mass silicone oil (KF50-100CS manufactured by Shin-Etsu Chemical Co., Ltd.) | 0.2 parts by mass |

Thus, an electrophotographic photoconductor in which the amino group-containing acryl-modified polyorganosiloxane is dispersed inside the photosensitive layer, i.e. the outermost surface was produced. In the photosensitive layer, the amino group-containing acryl-modified polyorganosiloxane was dispersed in a particle state. The average particle diameter thereof was 180 nm as determined by measurement of their sections with a transparent electron microscope (TEM).

The cleanability of the obtained photoconductor was evaluated in the same manner as that of the above-mentioned one. The photoconductor offered toner concentration of 0.01 as measured in a normal temperature and normal humidity environment (25° C., 50 RH %), 0.02 in a low temperature and low humidity environment (10° C., 15 RH %), and thus the photoconductor exhibited excellent cleanability in both environments.

Examples 15 to 27 and Comparative Examples 9 to 16

-Image Forming and Evaluation-

Images were formed using a color laser printer (IPSiO CX 8800 manufactured by Ricoh Company, Ltd) under the following conditions. Then, image formation performance was evaluated as follows. The results are shown in Table 4.

[Image Forming Condition]

Charging apparatus: A close non-contact charging roller system

Exposing apparatus: A laser beam scanning system with a wavelength of 655 nm

Developing apparatus: A two-component developing system using a toner produced by means of ester stretching polymerization method, the average circularity of the toner=0.98, the volume average particle diameter (Dv) of the toner=6.1 μm, and the ratio of Dv to Dn=1.12

Transferring apparatus: A direct transferring system

Cleaning apparatus: A blade cleaning system

Printing speed: Color 28 sheets/minute, Monochrome 32 sheets/minute

The lubricant application mechanism was removed and each of the electrophotographic photoconductors obtained in Examples 1 to 13 and Comparative Examples 1 to 8 was set to a process cartridge of each station of the same printer.

The test chart images were output in a normal temperature and normal humidity environment (25° C., 50 RH %) and in a low temperature and low humidity environment (10° C., 15 RH %).

<Cleanability>

A: It succeeded in complete cleaning followed by output of clear image.

B: Cleaning failed followed by output of tainted image.

For electrophotographic photoconductors whose cleanability was evaluated as A, one-dot reproducibility based on 1,200 dpi and the amount of change in the thickness of the photoconductor after printing of 10,000 sheets in a normal temperature and normal humidity environment were measured as follows.

<One-Dot Reproducibility>

One hundred dots were observed and one-dot reproducibility was determined as A when the number of dots that were printed clearly was 95 or more; B when 90 or more; and C when less than 90.

<Amount of Change in Thickness of Photoconductor>

The thickness of the photoconductor was measured with an eddy-current contact-type film thickness meter. The average of thicknesses at 10 points of the photoconductor before and after image formation was measured and the difference in film thickness between before and after image formation was defined as the amount of change in the thickness of the photoconductor. A large thickness change means that the abrasion amount of a photoconductor is large and the photoconductor has weak abrasion resistance.

TABLE 4

| | | Cleaning Ability | | | |
|---|---|---|---|---|---|
| | Electrophotographic Photoconductor | Normal Temperature and Normal Humidity | Low Temperature and Low Humidity | One-Dot Reproducibility | Amount of Change in Thickness (μm) |
| Example 15 | Example 1 | A | A | A | 3.2 |
| Example 16 | Example 2 | A | A | A | 2.5 |
| Example 17 | Example 3 | A | A | A | 0.4 |
| Example 18 | Example 4 | A | A | A | 0.5 |
| Example 19 | Example 5 | A | A | A | 0.4 |
| Example 20 | Example 6 | A | A | A | 0.5 |
| Example 21 | Example 7 | A | A | A | 0.5 |
| Example 22 | Example 8 | A | A | A | 0.5 |
| Example 23 | Example 9 | A | A | A | 0.4 |
| Example 24 | Example 10 | A | A | A | 0.4 |
| Example 25 | Example 11 | A | A | A | 0.3 |
| Example 26 | Example 12 | A | A | A | 0.2 |
| Example 27 | Example 13 | A | A | A | 0.3 |
| Comparative Example 9 | Comparative Example 1 | B | B | — | — |
| Comparative Example 10 | Comparative Example 2 | B | B | — | — |
| Comparative Example 11 | Comparative Example 3 | B | B | — | — |
| Comparative Example 12 | Comparative Example 4 | B | B | — | — |
| Comparative Example 13 | Comparative Example 5 | A | B | — | — |
| Comparative Example 14 | Comparative Example 6 | A | B | — | — |
| Comparative Example 15 | Comparative Example 7 | A | B | — | — |
| Comparative Example 16 | Comparative Example 8 | A | B | — | — |

From the results shown in table 4, the image forming apparatuses of Examples 15 to 27 can output high resolution images in a wide range of environmental conditions without lubricant application. In particular, in case of using the electrophotographic photoconductors of Examples 3 to 13 in which an acrylic curable resin was used in the surface protective layer, it is possible to provide an image forming apparatus that exhibits a small amount of abrasion during image formation, can operate for a prolonged period, make maintenance easy with a less frequency of photoconductor replacement.

In addition, it was established that the photoconductor has excellent high-speed printing ability because the image forming apparatus maintains favorable image formation at high-speed printing of 28 color sheets per minute and 33 monochrome sheets per minute.

In contrast, regardless of with or without the presence of the surface protective layer in case of using the electrophotographic photoconductors of Comparative Examples 1 to 8, in which an amino group-containing acryl-modified polyorganosiloxane was not contained in the surface protective layer, it was established that an image forming apparatus usable in a wide range of environmental conditions cannot be developed for practical use because the photoconductor cannot be cleaned without lubricant application in a low temperature and low humidity environment.

Comparative Example 17

-Image Forming and Evaluation-

The one-dot reproducibility in the monochrome printing of Comparative Example 17 was evaluated in the same manner as that of Example 15 except that a toner with the following properties produced by means of typical grinding process was packed to a black station of a developing device for using; one-dot reproducibility was evaluated as C.

<Toner>

Average circularity=0.93

Volume average particle diameter (Dv)=8.5 μm

Ratio of volume average particle diameter (Dv) to a number average particle diameter (Dn)=1.10

Comparative Example 18

-Image Forming and Evaluation-

The one-dot reproducibility in the monochrome printing of Comparative Example 18 was evaluated in the same manner as that of Example 15 except that a toner with the following properties produced by means of typical grinding process was packed to a black station of a developing device for using; one-dot reproducibility was evaluated as C.

<Toner>

Average circularity=0.902

Volume average particle diameter (Dv)=15.34 μm

Ratio of volume average particle diameter (Dv) to a number average particle diameter (Dn)=1.48

An image forming method, image forming apparatus, and process cartridge using the electrophotographic photoconductor of the present invention may be widely employed, for example, for full-color copiers, full-color laser printers, and full-color facsimiles of standard paper using a direct or indirect electrophotographic multi-color image developing system because the image forming method, image forming apparatus, and process cartridge using the electrophotographic photoconductor of the present invention can provide high-quality image formation and high-speed printing using a spherical toner with a small particle diameter, can provide an excellent toner recycling efficiency and low-temperature toner fixing properties, can provide excellent cleanability in a low temperature and low humidity environment, is robust against environmental variability, can provide high-quality image formation for a prolonged period without lubricant application.

What is claimed is:

1. An electrophotographic photoconductor comprising:

an outermost layer, wherein the outermost layer comprises an amino group-containing acryl-modified polyorganosiloxane, wherein the amino group-containing acryl-modified polyorganosiloxane is a copolymer in which a polyorganosiloxane represented by the following structural formula (1) and an acrylic monomer are graft-polymerized, Structural Formula (1)

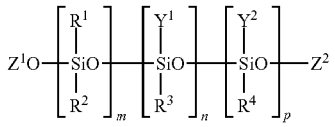

wherein $R^1$, $R^2$, $R^3$ and $R^4$ may be identical or different, and represent any one of a hydrocarbon group having 1 to 20 carbon atoms and a halogenated hydrocarbon group having 1 to 20 carbon atoms;

$Y^1$ represents an organic group having at least one of a radical reactive group and SH group;

$Y^2$ is at least one selected from the group consisting of a γ-aminopropyl group, a N-β(aminoethyl)-γ-aminopropyl group and a N-phenyl-γ-aminopropyl group;

$Z^1$ and $Z^2$ may be identical or different, and represent any one of a hydrogen atom, alkyl group, and group expressed by the following structural formula (1-1); m is a positive integer of 10,000 or less; and n and p each are an integer of 1 or more, Structural Formula (1-1)

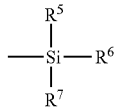

wherein $R^5$ and $R^6$ may be identical or different, and represent any one of a hydrocarbon group having 1 to 20 carbon atoms and halogenated hydrocarbon group having 1 to 20 carbon atoms; and $R^7$ represents any one of a hydrocarbon group having 1 to 20 carbon atoms, halogenated hydrocarbon group having 1 to 20 carbon atoms, and organic group having at least one of a radical reactive group and SH group.

2. The electrophotographic photoconductor according to claim 1, wherein a mass ratio (A:B) between the polyorganosiloxane (A) represented by the structural formula (1) and the acrylic monomer (B) is from 40:60 to 80:20.

3. The electrophotographic photoconductor according to claim 1, wherein the acrylic monomer is a (meth)acrylate represented by structural formula (2), or a mixture of the (meth)acrylate represented by structural formula (2) and a monomer copolymerizable with the (meth)acrylate, Structural Formula (2)

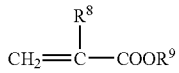

wherein $R^8$ represents one of a hydrogen atom and methyl group; and $R^9$ represents any one of an alkyl group, alkoxy substituted-alkyl group, cycloalkyl group, and aryl group, and these groups may further be substituted with substituent(s).

4. The electrophotographic photoconductor according to claim 3, wherein the acrylic monomer is a mixture of the methacrylate (C) represented by the structural formula (2) and a copolymerizable monomer (D) and a mass ratio (C:D) between the (meth)acrylate (C) represented by the structural formula (2) in the mixture and the monomer (D) copolymerizable with the (meth)acrylate in the mixture is 99.9:0.1 to 70:30.

5. The electrophotographic photoconductor according to claim 1, further comprising:
a support; and
a photosensitive layer formed on the support,
wherein the photosensitive layer is the outermost layer.

6. The electrophotographic photoconductor according to claim 1, further comprising:
a support;
a charge generating layer; and
a charge transporting layer,
wherein the charge generating layer and the charge transporting layer are sequentially disposed on the support,
wherein the charge transporting layer is the outermost layer.

7. The electrophotographic photoconductor according to claim 1, further comprising:
a support;
a photosensitive layer; and
a surface protective layer,
wherein the photosensitive layer and the surface protective layer are sequentially disposed on the support,
wherein the surface protective layer is the outermost layer.

8. The electrophotographic photoconductor according to claim 7, wherein the surface protective layer comprises an acrylic curable resin produced by chain polymerization reaction between a chain-polymerizable charge transporting compound with one or more chain-polymerizable groups in a molecule and chain-polymerizable compound with three or more functional groups.

9. An image forming apparatus comprising:
an electrophotographic photoconductor;
a latent electrostatic image forming unit configured to form a latent electrostatic image on the electrophotographic photoconductor;
a developing unit configured to develop the latent electrostatic image using a toner to form a visible image;
a transferring unit configured to transfer the visible image onto a recording medium;
a fixing unit configured to fix the transferred image on the recording medium; and
a cleaning unit configured to remove residual toners on the electrophotographic photoconductor,
wherein the electrophotographic photoconductor comprises an outermost layer which comprises an amino group-containing acryl-modified polyorganosiloxane,
wherein the amino group-containing acryl-modified polyorganosiloxane is a copolymer in which a polyorganosiloxane represented by the following structural formula (1) and an acrylic monomer are graft-polymerized,
wherein the toner has an average circularity of 0.92 to 1, a volume average particle diameter (Dv) of 4 μm to 8 μm, and the ratio between the volume average particle diameter (Dv) and a number average particle diameter (Dn) is 1.00 to 1.40, Structural Formula (1)

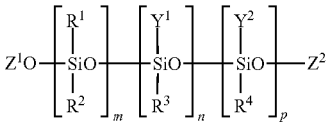

wherein $R^1$, $R^2$, $R^3$ and $R^4$ may be identical or different, and represent any one of a hydrocarbon group having 1 to 20 carbon atoms and halogenated hydrocarbon group having 1 to 20 carbon atoms;
$Y^1$ represents an organic group having at least one of a radical reactive group and SH group;
$Y^2$ is at least one selected from the group consisting of a γ-aminopropyl group, a N-β(aminoethyl)-γ-aminopropyl group and a N-phenyl-γ-aminopropyl group;
$Z^1$ and $Z^2$ may be identical or different, and represent any one of a hydrogen atom, alkyl group, and group represented by the following structural formula (1-1); m is a positive integer of 10,000 or less; and n and p each are an integer of 1 or more, Structural Formula (1-1)

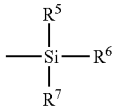

wherein $R^5$ and $R^6$ may be identical or different, and represent any one of a hydrocarbon group having 1 to 20 carbon atoms and halogenated hydrocarbon group having 1 to 20 carbon atoms; $R^7$ represents any one of a hydrocarbon group having 1 to 20 carbon atoms, halogenated hydrocarbon group having 1 to 20 carbon atoms, and organic group having at least any one of a radical reactive group and SH group.

10. The image forming apparatus according to claim 9, wherein the toner is obtained by dissolving and/or dispersing in an organic solvent a toner material containing an active hydrogen group-containing compound, a modified polyester resin that is reactive with the active hydrogen group-containing compound, a coloring agent, and a releasing agent to prepare a toner solution, emulsifying and/or dispersing the toner solution in an aqueous medium to prepare a dispersion liquid, allowing to react in the aqueous medium the active hydrogen group-containing compound and the modified polyester resin that is reactive with the active hydrogen group-containing compound, and removing the organic solvent.

11. The image forming apparatus according to claim 9, wherein the cleaning unit is a cleaning blade that contacts the surface of the electrophotographic photoconductor.

12. A process cartridge comprising:
an electrophotographic photoconductor; and at least one selected from
a charging unit configured to charge the surface of the electrophotographic photoconductor;
a developing unit configured to develop the latent electrostatic image formed on the electrophotographic photoconductor using a toner to form a visible image;
a transferring unit configured to transfer the visible image onto a recording medium; and
a cleaning unit configured to remove a residual toner on the electrophotographic photoconductor,
wherein the electrophotographic photoconductor comprises an outermost layer which comprises an amino group-containing acryl-modified polyorganosiloxane,
wherein the amino group-containing acryl-modified polyorganosiloxane is a copolymer in which a polyorganosiloxane represented by the following structural formula (1) and an acrylic monomer are graft-polymerized,
wherein the process cartridge is detachably attached to an image forming apparatus body,
wherein the toner has an average circularity of 0.92 to 1, a volume average particle diameter (Dv) of 4 μm to 8 μm, and the ratio between the volume average particle diameter (Dv) and a number average particle diameter (Dn) is 1.00 to 1.40, Structural Formula (1)

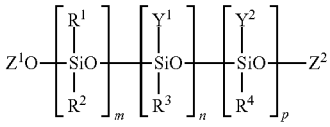

wherein $R^1$, $R^2$, $R^3$ and $R^4$ may be identical or different, and represent any one of a hydrocarbon group having 1 to 20 carbon atoms and halogenated hydrocarbon group having 1 to 20 carbon atoms;

$Y^1$ represents an organic group having at least one of a radical reactive group and SH group;

$Y^2$ is at least one selected from the group consisting of a γ-aminopropyl group, a N-β(aminoethyl)-γ-aminopropyl group and a N-phenyl-γ-aminopropyl group;

$Z^1$ and $Z^2$ may be identical or different, and represent any one of a hydrogen atom, alkyl group, and group represented by the following structural formula (1-1); m is a positive integer of 10,000 or less; and n and p each are an integer of 1 or more, Structural Formula (1-1)

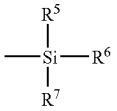

wherein $R^5$ and $R^6$ may be identical or different, and represent any one of a hydrocarbon group having 1 to 20 carbon atoms and halogenated hydrocarbon group having 1 to 20 carbon atoms; $R^7$ represents any one of a hydrocarbon group having 1 to 20 carbon atoms, halogenated hydrocarbon group having 1 to 20 carbon atoms, and organic group having at least any one of a radical reactive group and SH group.

13. The process cartridge according to claim 12, wherein the toner is obtained by dissolving and/or dispersing a toner material containing an active hydrogen group-containing compound, a modified polyester resin that is reactive with the active hydrogen group-containing compound, a coloring agent, and a releasing agent in an organic solvent to prepare a toner solution, emulsifying and/or dispersing the toner solution in an aqueous medium to prepare a dispersion liquid, allowing the active hydrogen group-containing compound and the modified polyester resin that is reactive with the active hydrogen group-containing compound to react in the aqueous medium, and removing the organic solvent.

14. The process cartridge according to claim 12, wherein the cleaning unit is a cleaning blade that contacts the surface of the electrophotographic photoconductor.

* * * * *